US008158319B2

(12) United States Patent
Arima et al.

(10) Patent No.: US 8,158,319 B2
(45) Date of Patent: Apr. 17, 2012

(54) TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

(75) Inventors: Yasuhiro Arima, Kanagawa (JP); Shinpei Takagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 244 days.

(21) Appl. No.: 12/722,912

(22) Filed: Mar. 12, 2010

(65) Prior Publication Data

US 2011/0065034 A1 Mar. 17, 2011

(30) Foreign Application Priority Data

Sep. 11, 2009 (JP) ..... 2009-210797

(51) Int. Cl.
*G03G 9/08* (2006.01)

(52) U.S. Cl. ..... 430/109.4; 399/252

(58) Field of Classification Search ..... 430/109.4; 399/252

See application file for complete search history.

(56) References Cited

U.S. PATENT DOCUMENTS

| | | | |
|---|---|---|---|
| 3,853,778 | A | 12/1974 | Buckley et al. |
| 5,346,797 | A | 9/1994 | Kmiecik-Lawrynowicz et al. |

FOREIGN PATENT DOCUMENTS

| | | |
|---|---|---|
| JP | B-42-23910 | 11/1967 |
| JP | B2-56-13943 | 10/1973 |
| JP | B2-62-39428 | 6/1981 |
| JP | A-63-282752 | 11/1988 |
| JP | A-6-250439 | 9/1994 |
| JP | A-2007-298687 | 11/2007 |

*Primary Examiner* — Mark A Chapman
(74) *Attorney, Agent, or Firm* — Oliff & Berridge, PLC

(57) ABSTRACT

A toner for electrostatic charge image development, the toner includes a binder resin, the binder resin includes an amorphous polyester resin having alkenyl groups and a crystalline polyester resin, about 5% or more of the alkenyl groups have a branched structure, and the o crystalline polyester resin has an ester concentration (M) obtained by the following Equation of from about 0.04 to about 0.08:

$$M=K/A \qquad \text{Equation}$$

wherein, K represents the number of ester bonds in the crystalline polyester resin, and A represents the number of atoms that constitute the polymer chain of the crystalline polyester resin.

16 Claims, 2 Drawing Sheets

TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

CROSS-REFERENCE TO RELATED APPLICATION

This application is based on and claims priority under 35 USC 119 from Japanese Patent Application No. 2009-210797 filed on Sep. 11, 2009.

BACKGROUND

1. Technical Field

The present invention relates to a toner for electrostatic charge image development, an electrostatic charge image developer, a toner cartridge, a process cartridge and an image forming device.

2. Related Art

A number of electrophotographic methods have been known.

As a method of producing a toner used for electrophotographic methods, for example, a method of producing a toner by emulsion aggregation and coalescence processes has been proposed.

Further, a toner in which a combination of a crystalline polyester resin and an amorphous polyester resin are used as a binder resin has been proposed 5% or more.

SUMMARY

According to an aspect of the invention, there is provided a toner for electrostatic charge image development including a binder resin, the binder resin including an amorphous polyester resin having alkenyl groups and a crystalline polyester resin, about 5% or more of the alkenyl groups having a branched structure, and the crystalline polyester resin having an ester concentration (M) obtained by the following Equation of from about 0.04 to about 0.08:

$$M=K/A \qquad \text{Equation}$$

wherein, K represents the number of ester bonds in the crystalline polyester resin, and A represents the number of atoms that constitute the polymer chain of the crystalline polyester resin.

BRIEF DESCRIPTION OF THE DRAWINGS

Exemplary embodiments of the present invention will be described in detail based on the following figures, wherein.

DETAILED DESCRIPTION

Figure 1:
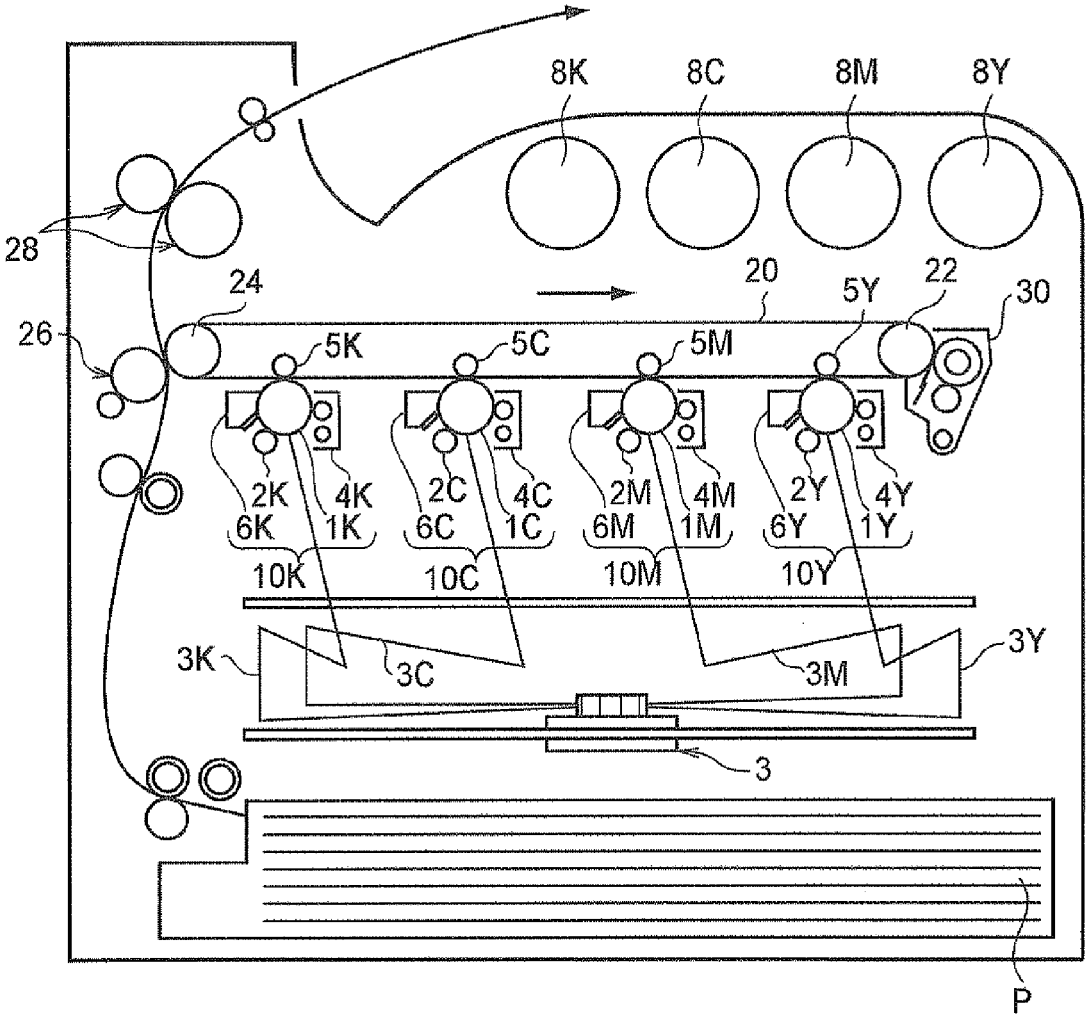
FIG. 1 is a schematic drawing showing an example of an image forming device according to an exemplary embodiment of the invention.

Hereinafter, the toner for electrostatic charge image development, the electrostatic charge image developer, the toner cartridge, the process cartridge and the image forming device of an exemplary embodiment of the invention is described in detail.

Toner for Electrostatic Charge Image Development

The toner for electrostatic charge image development according to the present exemplary embodiment (hereinafter, sometimes simply referred to as a "toner") include a toner for electrostatic charge image development including a binder resin, the binder resin including an amorphous polyester resin having alkenyl groups and a crystalline polyester resin, 5% or more (or about 5% or more) of the alkenyl groups having a branched structure, and the crystalline polyester resin having an ester concentration (M) obtained by the following Equation of from 0.04 to 0.08 (or about 0.04 to about 0.08):

$$M=K/A \qquad \text{Equation}$$

wherein, K represents the number of ester bonds in the crystalline polyester resin, and A represents the number of atoms that constitute the polymer chain of the crystalline polyester resin.

In general, when an ester concentration (M) of a crystalline polyester resin in a toner is adjusted within the above range in order to realize low-temperature fixability, the degree of freedom of motion of the crystalline polyester resin at ester bonds increases as compared with the case where an ester concentration (M) of a crystalline polyester resin is lower than the above range, and as a result of which, chargeability of the toner decreases. It is thought that, when a toner is exposed to an electric field (especially, an alternating electric field) in a development process or the like, the effect of increase in the degree of freedom of motion at ester bonds becomes significant, and the chargeability of the toner largely decreases. Furthermore, it is thought that, when an image is formed under the conditions of high temperature and high humidity (for example, at a temperature of 35° C. and at a relative humidity of 50%), the degree of motion at ester bonds increases and the chargeability of a toner decreases due to the high temperature, and the chargeability of the toner decreases due to the influence of water vapor under the high humidity.

However, in the present exemplary embodiment, when the ester concentration (M) of the crystalline polyester resin and the number of the alkenyl groups each having a branched structure are within the above ranges, a toner having low-temperature fixability may be obtained, and decrease in the chargeability of the toner may be suppressed. The reason for this is not clear, but may be presumed as follows.

In the toner of the present exemplary embodiment, the ester concentration (M) of the crystalline polyester resin is within the above range, and 5% or more (or about 5% or more) of the alkenyl groups in the amorphous polyester resin have a branched structure. When the number of the alkenyl groups each having a branched structure is within the above range, the alkenyl groups in the amorphous polyester resin may be intricately entangled with the polymer chain of the crystalline polyester resin. As a result, in the toner of the present exemplary embodiment, the affinity of the amorphous polyester resin and the crystalline polyester resin may be increased, and the degree of freedom of motion of the crystalline polyester resin at the ester bonds is reduced due to the entanglement. Therefore, in the toner of the present exemplary embodiment, even when the ester concentration (M) of the crystalline polyester resin is within the above range, the decrease in the chargeability of the toner caused by the increase in the degree of freedom of motion at the ester bonds may be suppressed, and the decrease in developability and transferability caused by the decrease in the chargeability of the toner may be suppressed.

In the toner of the present exemplary embodiment, when the ester concentration (M) of the crystalline polyester resin is within the above range, decrease in chargeability of the toner caused by the increase in the degree of freedom of motion at the ester bonds may be suppressed.

Furthermore, in the present exemplary embodiment, when the ester concentration (M) of the crystalline polyester resin is within the above range, the toner may exhibit excellent low-temperature fixability. Here, the "low-temperature fixability" means a property such that the toner is fixed by heating at about 150° C. or less. The reason why the toner of the present exemplary embodiment exhibits excellent low-temperature fixability is uncertain. However, it is thought that an increase in a melting temperature of the crystalline polyester resin, which is caused when the ester concentration (M) is considerably low, may be suppressed.

In general, it is thought that, when an aliphatic polyester resin is used as the crystalline polyester resin, the decrease in the chargeability of the toner caused by the increase in the degree of freedom of motion at the ester bonds is significant. It is thought that this is because the aliphatic polyester resin may exhibit less steric hindrance as compared with an aromatic polyester resin, and as a result of which, ester bonds in the aliphatic polyester resin may easily move.

However, in the toner of the present exemplary embodiment, not only when an aromatic polyester resin is used as the crystalline polyester resin, but also when an aliphatic polyester resin is used as the crystalline polyester resin, the decrease in the chargeability of the toner may be suppressed, and as a result of which the decrease in developability and transferability may be suppressed.

Here, an aliphatic polyester resin as the crystalline polyester resin indicates a crystalline polyester resin in which a content of an aliphatic structural unit (that is, a structural unit that does not contain an aromatic ring) is 75% by mol or more with respect to the total structural units thereof.

In the present exemplary embodiment, when the number of carbon atoms in the branched moiety of the alkenyl group having a branched structure in the amorphous polyester resin is from 2 to 5 (or from about 2 to about 5), the decrease in the chargeability of the toner may be suppressed. It is thought that, when the number of carbon atoms in the branched moiety is within the above range, the alkenyl group having a branched structure may intricately entangled with the polymer chain of the crystalline polyester resin.

Here, the "branched moiety" means a moiety other than the main chain (the longest chain), that is, a side chain moiety, of the alkenyl group having a branched structure. The "number of carbon atoms in the branched moiety" means the number of carbon atoms in the side chain, and, when plural branched moieties are included, means the sum total number carbon atoms in the plural branched moieties.

The number of carbon atoms in the branched moiety can be determined based on an NMR analysis. Since the difference in degree of the branching affects the melting temperature of an alkenyl succinic acid, the alkenyl succinic acids with different branching degrees can be isolated by a fractional distillation. The number of carbon atoms in the branched moiety of an alkenyl succinic acid in an obtained toner can be determined, by comparing NMR spectral profiles of the alkenyl succinic acid in the obtained toner with H-NMR and C-NMR spectral profiles of the alkenyl succinic acids with different branching degrees obtained by the fractional distillation.

Hereinafter, materials, process conditions, evaluation and analytical conditions and the like used in the present exemplary embodiment are described in detail.

Binder Resin

In the toner according to the present exemplary embodiment, an amorphous polyester resin having an alkenyl group and a crystalline polyester resin are used as a binder resin.

If necessary, another binder resin (for example, styrene acrylate resin) may be used in combination. When another binder resin is used in combination, the total amount of the amorphous polyester resin having an alkenyl group and the crystalline polyester resin is preferably adjusted to 50% by weight or more (or about 50% by weight or more), and more preferably to 70% by weight or more (or about 70% by weight or more), with respect to the total amount of the binder resins.

The melting temperature or the glass transition temperature of the binder resin is preferably in the range of from 45° C. to 110° C. (or from about 45° C. to about 110° C.), and more preferably from 60° C. to 90° C. (or from about 60° C. to about 90° C.). More specifically, for example, a combination of a crystalline polyester resin having a melting temperature of from 60° C. to 90° C. and an amorphous polyester resin having a glass transition temperature of from 50° C. to 90° C. may be used as a binder resin.

The mixing ratio of the amorphous polyester resin having an alkenyl group and the crystalline polyester resin can be selected in consideration of the relation between the melting temperature of the crystalline polyester resin and the glass transition temperature of the amorphous polyester resin. In general, since the thermal melting property of a component of relatively high content is dominant, it is preferable to select a resin component which does not inhibit low-temperature fixability.

The melting temperature can be determined based on a melting peak temperature observed on a power compensation differential scanning calorimetry in accordance with JIS K-7121 (which corresponds to ISO 3146, 1985). In a crystalline polyester resin, when multiple melting peaks are obtained, the maximum peak is regarded as the melting temperature.

Here, the glass transition temperature is a value obtained in accordance with ASTM D3418-82 (DSC method).

Crystalline Polyester Resin

The crystalline polyester resin can be synthesized by a reaction between a polyvalent carboxylic acid component and a polyhydric alcohol component. In the present exemplary embodiment, as the crystalline polyester resin, a commercially available product may be used or a synthesized compound may be used. Hereinafter, preferable examples of a polyvalent carboxylic acid component and a polyhydric alcohol component, which can be used for synthesizing the crystalline polyester resin, are described.

Examples of the polyvalent carboxylic acid component include, but not limited to, an aliphatic dicarboxylic acid such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; and an aromatic dicarboxylic acid including a dibasic acid such as phthalic acid, isophthalic acid, terephthalic acid, naphthalene-2,6-dicarboxylic acid, malonic acid, mesaconic acid; and anhydrides and lower alkyl esters thereof.

Examples of a trivalent or higher-valent carboxylic acid include 1,2,3-benzene tricarboxylic acid, 1,2,4-benzene tricarboxylic acid, 1,3,5-benzene tricarboxylic acid, 1,2,4-naphthalene tricarboxylic acid; and anhydrides and lower alkyl esters thereof. These compounds may be used singly or in combination of two or more kinds thereof.

In addition to the aliphatic dicarboxylic acid and the aromatic dicarboxylic acid, examples of the polyvalent carboxylic acid component include a dicarboxylic acid component having a sulfonic acid group.

Specific examples of the dicarboxylic acid having a sulfonic acid group include, but are not limited thereto, sodium 2-sulfoterephthalate, sodium 5-sulfoisophthalate and sodium sulfosuccinate; and lower alkyl esters and acid anhydrides thereof. The content of the dicarboxylic acid component having a sulfonic acid group is preferably in the range of from 1% by mol to 15% by mol, and more preferably in the range of from 2% by mol to 10% by mol, with respect to the total amount of the carboxylic acid components of the polyester.

In addition to the aliphatic dicarboxylic acid and the aromatic dicarboxylic acid, the polyvalent carboxylic acid component may contain a dicarboxylic acid component having a double bond. Examples of the dicarboxylic acid having a double bond include, but not limited thereto, maleic acid, fumaric acid, 3-hexenedioic acid and 3-octenedioic acid; and lower alkyl esters and anhydrides thereof.

Examples of the polyhydric alcohol component include an aliphatic diol, and more specifically, a straight-chain aliphatic diol having 7 to 20 carbon atoms in the main chain thereof. The number of carbon atoms of the aliphatic diol is preferably 14 or less.

Preferable examples of the aliphatic diol used for synthesizing the crystalline polyester include but not limited thereto, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. Among these, 1,8-octanediol, 1,9-nonanediol and 1,10-decanediol are preferable.

Examples of the trivalent or higher-valent alcohol include glycerin, trimethylol ethane, trimethylol propane and pentaerythritol. These compounds may be used singly or in combination of two or more kinds thereof.

The content of aliphatic diol component in the polyhydric alcohol component is preferably 80% by mol or more, and more preferably 90% by mol or more, with respect to the total diol components.

If necessary, for the purpose of controlling an acid value or a hydroxyl value, a monovalent acid such as acetic acid or benzoic acid, and/or a monovalent alcohol such as cyclohexanol or benzyl alcohol may be used.

Here, the "crystalline polyester resin" refers to a rein showing a clear endothermic peak rather than a step-wise change in an endothermic amount in the differential scanning calorimetry. More specifically, the "crystalline polyester resin" refers to a resin showing a half width of an endothermic peak of 6° C. or less when measured at a temperature-rising rate of 10° C./min. A resin having a half width of more than 6° C., or a resin which does not show a clear endothermic peak is defined as an amorphous resin. The amorphous resin used in the present exemplary embodiment may be resin which does not show a clear endothermic peak.

Furthermore, the "crystalline polyester resin" may be a polymer containing 100% of a polyester structure, or may be a polymer (copolymer) formed by copolymerizing a component having a polyester structure with other constituent components. However, in the latter case, it is preferable that the content of the constituent components other than the component having a polyester structure in the polymer (copolymer) is adjusted to 50% by weight or less.

The acid value (mg of KOH required to neutralize 1 g of resin) of a polyester resin may be in the range of from 1 mg KOH/g to 30 mg KOH/g (or from about 1 mg KOH/g to about 30 mg KOH/g). The acid value of a polyester resin may be adjusted by controlling the content of carboxyl groups at the terminal ends of the polyester based on the compounding ratio and reaction rate of raw materials including a polyvalent carboxylic acid and a polyhydric alcohol. Alternatively, the acid value of a polyester resin may be adjusted to contain carboxyl groups in the main chain of the polyester by using a trimellitic anhydride as a polyvalent carboxylic acid component.

In the present exemplary embodiment, the ester concentration (M) of the crystalline polyester resin is within the range as described above.

Here, the ester concentration (M) of the crystalline polyester resin is obtained by the following Equation:

$$M=K/A \qquad \text{Equation}$$

wherein K represents the number of ester bonds in the crystalline polyester, and A represents the number of atoms that constitute the polymer chain of the crystalline polyester.

Here, the ester concentration (M) of the crystalline polyester resin is an index that indicates the content of ester bonds in the crystalline polyester resin. The "number of ester bonds in the crystalline polyester" represented by K in the above Equation refers to the number of ester bonds contained in the entire crystalline polyester resin.

The "number of atoms that constitute the polymer chain of the crystalline polyester" represented by A in the above Equation means the total number of the atoms that constitute the polymer chain of the crystalline polyester resin, and includes the number all atoms involved in the ester bonds, but does not include the number of atoms contained in the other moieties (branched moieties). For example, the number of atoms that constitute the polymer chain of the crystalline polyester includes the number of carbon atoms and oxygen atoms derived from a carboxyl group or an alcohol group involved in the ester bonds (for example, the number of oxygen atoms per one ester bond is 2), or the number of atoms that constitute the polymer chain (for example, six carbon atoms that constitute an aromatic ring). On the other hand, the number of atoms that constitute the polymer chain of the crystalline polyester includes neither the number of hydrogen atoms in an aromatic ring or in an alkyl group constituting the polymer chain, nor atoms or atomic groups in a substituent of the polymer chain.

More specifically, in an arylene group constituting a polymer chain that contains 10 atoms including 6 carbon atoms and 4 hydrogen atoms, the "number of atoms that constitutes the polymer chain of the crystalline polyester" is 6, which is derived from carbon atoms. Even when the hydrogen atoms are substituted by any substituents, the "number of atoms that constitute the polymer chain of the crystalline polyester" does not include the number of the atoms that constitute the substituents.

For example, when the crystalline polyester resin is a homopolymer having a single type of repeating unit, for example, the homopolymer represented by:

$$H—[OCOR^1COOR^2O—]_n—H$$

wherein the formula in the parentheses represents the repeating unit; $R^1$ and $R^2$ each independently represent a monovalent group; and n represents an integer of one or more, the single repeating unit includes two ester bonds (that is, the number (K') of ester bonds in the repeating unit is 2), and the ester concentration (M) of the crystalline polyester resin can be obtained by the following Equation:

$$M=2/A' \qquad \text{Equation}$$

wherein A' represents the number of atoms that constitutes the polymer chain in the single repeating unit.

The ester concentration (M) of the crystalline polyester resin herein refers to a value obtained in accordance with the above-described calculation.

The ester concentration (M) of the crystalline polyester resin in an electrophotographic toner can be determined by removing toluene-solubles from the toner and separating a crystalline resin, and then identifying the structure of polymer based on an NMR analysis or the like.

Examples of a method of controlling the ester concentration (M) of the crystalline polyester resin include a method of polycondensing monomers of an acid and/or an alcohol, which are selected such that the ester concentration of the crystalline polyester resin is within the above range. Examples of the crystalline polyester resin in which the ester concentration (M) is within the above range include a resin formed by using 1,10-dodecane dicarboxylic acid as a polyvalent carboxylic acid component and 1,9-nonanediol as a polyhydric alcohol component.

The ester concentration (M) of the crystalline polyester resin is preferably from 0.04 to 0.06 (or from about 0.04 to 0.06). When the ester concentration (M) is within the above range, decrease in chargeability of the toner may be suppressed.

Amorphous Polyester Resin

The amorphous polyester resin used in the present exemplary embodiment includes alkenyl groups, and 5% or more (or about 5% or more) of the alkenyl groups have a branched structure.

Here, the number of alkenyl groups having a branched structure is determined by the following manner. For example, various amorphous polyester resins are synthesized by using a specific alkenyl succinic acid having a branched structure, and then a measurement is carried out by a $^{1}$H-NMR method. A calibration curve is prepared based on a peak intensity derived from the alkenyl group in the $^{1}$H-NMR spectrum against the number of the alkenyl groups having a branched structure. The number of alkenyl groups having a branched structure in a sample can be determined by comparing a result obtained by a $^{1}$H-NMR measurement of the sample with the above-described calibration curve.

More specifically, for example, when an amorphous polyester resin having a dodecenyl group is measured, an amorphous polyester resin is prepared by using dodecenyl succinic acid having a branched structure, and then a measurement is carried out by a $^{1}$H-NMR method. Subsequently, it is confirmed that the profiles of the $^{1}$H-NMR spectra are not different when the ratio of the dodecenyl succinic acid having a branched structure in dodecenyl succinic acid is within the range of from 5% by mol to 20% by mol. Then four types of amorphous polyester resins, each of which has a different number of dodecenyl groups from one another, are synthesized using dodecenyl succinic acid that has a branched structure at a ratio of 20% by mol and dodecenyl succinic acid that has a branched structure at a ratio of 5% by mol or less, while changing the addition amount of dodecenyl succinic acids. Thereafter, calibration curves are prepared based on the measurement using the four types of the amorphous polyester resins.

The amorphous polyester resin can be synthesized by dehydration-condensation of a polyvalent carboxylic acid and a polyhydric alcohol. Examples of a method of synthesizing the amorphous polyester resin containing alkenyl groups include a method of using an alkenyl succinic acid having alkenyl groups as a polyvalent carboxylic acid component.

Examples of the alkenyl succinic acid include an alkenyl succinic acid having an alkenyl group containing 12 to 18 carbon atoms (or about 12 to 18 carbon atoms). Specific examples thereof include an alkenyl succinic acid having an alkenyl group containing 12 carbon atoms such as dodecenyl succinic acid, which is easy to obtain. By the use of dodecenyl succinic acid as a polyvalent carboxylic acid, an amorphous polyester resin containing an alkenyl group having 12 carbon atoms (namely, dodecenyl group) can be synthesized.

As described above, in the amorphous polyester resin of the present exemplary embodiment, 5% or more of the alkenyl groups have a branched structure. Examples of a method of synthesizing this amorphous polyester resin include a method of using, as a polyvalent carboxylic acid, alkenyl succinic acids having alkenyl groups in which 5% by mol or more the alkenyl groups have a branched structure.

Examples of a method of obtaining the alkenyl succinic acids having alkenyl groups in which 5% by mol or more of the alkenyl groups have a branched structure include a method in which an alkene including 5% by mol or more of a branched structure is used to synthesize the alkenyl succinic acid.

Here, Examples of a method of obtaining the alkene including 5% by mol or more of a branched structure include a method in which an alkene having a branched structure is fractionally distilled to adjust the ratio of an alkene having a branched structure to 5% by mol or more. The fractional distillation is performed based on that the boiling temperatures of alkenes, which vary with the presence of a branched structure or the number of carbon atoms in a branched moiety.

In the amorphous polyester resin, it is preferable that 5% or more (or about 5% or more) of the alkenyl groups have a branched structure, more preferable that 7% or more (or about 7% or more) of the alkenyl groups have a branched structure, and still more preferable that 10% or more (or about 10% or more) of the alkenyl groups have a branched structure.

As the polyvalent carboxylic acid, polyvalent carboxylic acids other than the above-described alkenyl succinic acid having an alkenyl group may be used in combination. In the polyvalent carboxylic acid used for synthesizing the amorphous polyester resin, the amount of the above-described alkenyl succinic acid having an alkenyl group is preferably from 5% by weight to 35% by weight, and more preferably from 10% by weight to 30% by weight.

Examples of the other polyvalent carboxylic acids include an aromatic carboxylic acid such as terephthalic acid, isophthalic acid, phthalic anhydride, trimellitic anhydride, pyromellitic acid or naphthalene dicarboxylic acid; an aliphatic carboxylic acid such as maleic anhydride, fumaric acid, succinic acid, alkenyl succinic anhydride or adipic acid; and an alicyclic carboxylic acid such as cyclohexane dicarboxylic acid.

Examples of the polyhydric alcohols include an aliphatic dial such as ethylene glycol, diethylene glycol, triethylene glycol, propylene glycol, butanediol, hexanediol, neopentyl glycol or glycerin; an alicyclic diol such as cyclohexanediol, cyclohexane dimethanol or hydrogenated bisphenol A; and an aromatic diol such as an ethylene oxide adduct of bisphenol A or a propylene oxide adduct of bisphenol A. These polyhydric alcohols may be uses singly or in combination of two or more kinds thereof. Among these polyhydric alcohols, an aromatic dial and an alicyclic diol are preferable, and an aromatic diol are more preferable. Further, a trivalent or higher-valent polyhydric alcohol (such as glycerin, trimethylol propane or pentaerythritol) may be used in combination with these diols.

Furthermore, in order to adjust the acid value of the polyester resin, a monocarboxylic acid and/or monoalcohol may be added to the polyester resin obtained by polycondensation of a polyvalent carboxylic acid and a polyhydric alcohol, thereby esterifing a hydroxyl group and/or carboxyl group at a polymerization end. Examples of the monocarboxylic acid include acetic acid, acetic anhydride, benzoic acid, trichloroacetic acid, trifluoroacetic acid and propionic anhydride. Examples of monoalcohol include methanol, ethanol, propanol, octanol, 2-ethylhexanol, trifluoroethanol, trichloroethanol, hexafluoroisopropanol and phenol.

The polyester resin used in the present exemplary embodiment may be produced by a condensation reaction of the above-described polyhydric alcohol and the above-described polyvalent carboxylic acid according to the conventional method. For example, the polyhydric alcohol and the polyvalent carboxylic acid (and optionally a catalyst) are placed in a reaction vessel equipped with a thermometer, a stirrer and a downflow condenser, and the mixture is heated at temperatures of 150° C. to 250° C. under an inert gas (nitrogen gas or the like). During the reaction, low molecular compounds produced as byproducts are continuously removed from the reaction system. The reaction is then stopped at the time when the intended acid value is obtained, and the reaction product is cooled, thereby obtaining a target reaction product.

Examples of the catalyst used in synthesizing the polyester resin include an esterification catalyst such as an organic metal (for example, dibutyltin dilaurate or dibutyltin oxide) or a metal alkoxide (for example, tetrabutyl titanate). The addition amount of the catalyst may be in the range of from 0.01% by weight to 1.00% by weight with respect to the total amount of raw materials.

The glass transition temperature of the amorphous polyester resin of the present exemplary embodiment is preferably in the range of from 45° C. to 110° C. (or from about 45° C. to about 110° C.), and more preferably from 60° C. to 90° C. (or from about 60° C. to about 90° C.).

Other Amorphous Resin

In the present exemplary embodiment, an additional amorphous resin may be used together with the above-described amorphous polyester resin. Examples of the additional amorphous resin that can be used in the toner according to the present exemplary embodiment include known thermoplastic binder resins. Specific examples thereof include a homopolymer or a copolymer of styrenes (styrene resin) such as styrene, parachlorostyrene or α-methyl styrene; a homopolymer or a copolymer of esters having vinyl groups (vinyl resin) such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate or 2-ethylhexyl methacrylate; a homopolymer or a copolymer of vinyl nitriles (vinyl resin) such as acrylonitrile or methacrylonitrile; a homopolymer or a copolymer of vinyl ethers (vinyl resin) such as vinyl methyl ether or vinyl isobutyl ether; a homopolymer or a copolymer of vinyl ketones (vinyl resin) such as vinyl methyl ketone, vinyl ethyl ketone or vinyl isopropenyl ketone; a homopolymer or a copolymer of olefins (olefin resin) such as ethylene, propylene, butadiene or isoprene; a non-vinyl condensation resin such as an epoxy resin, a polyurethane resin, a polyamide resin, a cellulose resin or a polyether resin, and a graft polymer of vinyl monomers and these non-vinyl condensation resin.

These additional amorphous resins may be used singly or in combination of two or more kinds thereof. Among these, a vinyl resin is preferable.

When vinyl resins are used, a resin particle dispersion liquid may be easily prepared by emulsion polymerization or seed polymerization using an ionic surfactant or the like. Examples of the vinyl monomer include a monomer that can be used as a raw material of a vinyl polymeric acid or a vinyl polymeric base (for example, acrylic acid, methacrylic acid, maleic acid, cinnamic acid, fumaric acid, vinyl sulfonic acid, ethyleneimine, vinyl pyridine or vinyl amine).

Colorant

The toner of the present exemplary embodiment may contain a colorant, if necessary.

Examples of colorant include carbon black such as furnace black, channel black, acetylene black or thermal black; an inorganic pigment such as red iron oxide, Prussian blue or titanium oxide; an azo pigment such as fast yellow, disazo yellow, pyrazolone red, chelate red, brilliant carmine or parabrown; a phthalocyanine pigment such as copper phthalocyanine or non-metal phthalocyanine; and a condensed polycyclic pigment such as flavanthrone yellow, dibromoanthrone orange, perylene red, quinacridone red or dioxazine violet.

More specifically, examples of pigments include Chrome Yellow, Hansa Yellow, Benzidine Yellow, Threne Yellow, Quinoline Yellow, Permanent Orange GTR, Pyrazolone Orange, Vulcan Orange, Watchyoung Red, Permanent Red, DuPont Oil Red, Lithol Red, Rhodamine B Lake, Lake Red C, Rose Bengal, Aniline Blue, Ultramarine Blue, Calco Oil Blue, Methyleneblue Chloride, Phthalocyanine Blue, Phthalocyanine Green, Malachite Green Oxalate, C. I. Pigment Red 48:1, C. I. Pigment Red 122, C. I. Pigment Red 57:1, C.I. Pigment Yellow 12, C. I. Pigment Yellow 97, C. I. Pigment Yellow 17, C. I. Pigment Blue 15:1, and C. I. Pigment Blue 15:3. These pigments may be used singly or in combination of two or more kinds thereof.

If necessary, a surface-treatment colorant may be used. Furthermore, if necessary, a pigment dispersant may be used in combination. A yellow toner, a magenta toner, a cyan toner, a black toner and the like may be obtained by appropriately selecting the types of the pigments.

The content of the colorant is preferably from 1 part by weight to 30 parts by weight, more preferably from 1 part by weight to 20 parts by weight, still more preferably from 1 part by weight to 10 parts by weight, still more preferably from 2 parts by weight to 10 parts by weight, and even more preferably from 2 parts by weight to 7 parts by weight, with respect to 100 parts by weight of the binder resin.

Release Agent

The toner of the present exemplary embodiment may contain a release agent, if necessary.

Examples of the release agent include, but not limited thereto, a natural wax such as carnauba wax, rice wax or Candelilla wax; a synthetic or mineral/petroleum wax such as a low molecular weight polypropylene, a low molecular weight polyethylene, SASOL WAX (trade name; manufactured by Sasol Wax AG), microcrystalline wax, Fisher-Tropsch wax, paraffin wax or Montan wax; an ester wax such as aliphatic esters or Montan ester. These release agents may used singly or in combination of two or more kinds thereof.

The melting temperature of the release agents is preferably 60° C. or more (or about 60° C. or more), and more preferably 70° C. or more (or about 70° C. or more), from the viewpoint of the storability. In consideration of offset resistance at low-temperature fixation (for example, fixation at a temperature of 150° C. or less), the melting temperature of the release agent is preferably 110° C. or less (or about 110° C. or less), and more preferably 100° C. or less (or about 100° C. or less). A release agent having a melting temperature of 100° C. or less and a release agent having a melting temperature of 100° C. or more may be used in combination.

The content of the release agent is preferably in the range of from 1 part by weight to 30 parts by weight (or from about 1 part by weight to about 30 parts by weight), and more preferably in the range of from 2 parts by weight to 20 parts by weight (or from about 2 parts by weight to about 20 parts by weight), with respect to 100 parts by weight of the binder resin.

Internal Additive

The toner of the present exemplary embodiment may contain an internal agent, if necessary.

The internal additive may be added, for example, by a wet method. Examples of the internal additive include magnetic substances such as a metal or alloy (for example, ferrite, magnetite, reduced iron, cobalt or manganese) and compounds containing these metals.

For example, a quaternary ammonium salt, a nigrosine compound, a dye containing a complex of aluminum, iron or chromium, or a triphenylmethane pigment may be used as a charge control agent.

Further, inorganic powder may be added for the purpose of controlling the viscoelasticity of the toner. Specific examples of inorganic powder include any inorganic particles that can be used as an external additive for the surface of toner particles, such as silica, alumina, titania, calcium carbonate, magnesium carbonate, calcium phosphate or cerium oxide.

External Additives

The toner of the present exemplary embodiment may contain an external agent, if necessary.

Examples of the external additives that can be added to the surface of toner mother particles by a wet method include an inorganic particle and an organic particle.

Examples of the inorganic particle include silica, alumina, titanium oxide, barium titanate, magnesium titanate, calcium titanate, strontium titanate, zinc oxide, silica sand, clay, mica, wollastonite, diatom earth, cerium chloride, red iron oxide, chromic oxide, cerium oxide, antimony trioxide, magnesium oxide, zirconium oxide, silicon carbide and silicon nitride. Among these particles, silica particle and titanium oxide particle are preferable. The particle may be subjected to a hydrophobicizing treatment.

In general, the inorganic particle is generally used for the purpose of increasing flowability. The primary particle diameter of the inorganic particles may be from 1 nm to 200 nm, and the addition amount of the inorganic particle may be from 0.01 parts by weight to 20 parts by weight, with respect to 100 parts by weight of toner mother particles.

In general, the organic particle is used for the purpose of improving cleaning property and transferability. Examples of organic particle include polystyrene, polymethyl methacrylate and polyvinylidene fluoride.

Physical Properties of Toner

The melting temperature of the toner is not specifically limited, and preferably in the range of from 45° C. to 110° C. (or about from 45° C. to about 110° C.), and more preferably in the range of from 60° C. to 90° C. (or about from 60° C. to about 90° C.).

The melting temperature of the toner can be obtained as a malting peak temperature observed on a power compensation differential scanning calorimetry in accordance with JIS K-7121 (which corresponds to ISO 3146, 1985).

The volume average particle diameter of the toner according to the present exemplary embodiment is preferably from 1 μm to 20 μm (or from about 1 μm to about 20 μm), and more preferably from 2 μm to 8 μm (or from about 2 μm to about 8 μm). The number average particle diameter of the toner is preferably from 1 μm to 20 μm (or from about 1 μm to about 20 μm), and more preferably from 2 μm to 8 μm (from about 2 μm to about 8 μm).

Here, the volume average particle diameter and number average particle diameter can be measured, for example, by using COULTER MULTISIZER H (trade name; manufactured by Beckman Coulter, Inc.) using ISOTON II (trade name; manufactured by Beckman Coulter, Inc.) as an electrolyte.

In the measurement of the volume average particle diameter and the number average particle diameter, 0.5 mg to 50 mg of a measurement sample is added to 2 ml of an aqueous solution of a surfactant as a dispersant (for example, a 5% by weight aqueous sodium alkylbenzene sulfonate solution). The mixture is added to 100 ml to 150 ml of an electrolytic solution.

The electrolytic solution in which the sample is suspended is subjected to a dispersion process for 1 minute using an ultrasonic dispersing apparatus, and the particle size distribution in the range of from 2 μm to 50 μm is measured using COULTER MULTISIZER II (trade name) with an aperture diameter of 100 μm. The number of particles to be sampled is 50,000.

First, on the basis of the measured particle size distribution of the toner, volumes and numbers in particle size ranges (channels) are plotted in respective cumulative distributions, accumulating from the small diameter side. Particle diameters for accumulations of 16% are defined as a cumulative volume average particle diameter D16v and a cumulative number average particle diameter D16p, particle diameters for accumulations of 50% are defined as a cumulative volume average particle diameter D50v and a cumulative number average particle diameter D50p, and particle diameters or accumulations of 84% is defined as a cumulative volume average particle diameter D84v and a cumulative number average particle diameter D84p.

Here, the volume average particle diameter is obtained as the accumulated volume average particle diameter D50v, and the number average particle diameter is obtained as the accumulated number average particle diameter D50p.

Preparation Method of Toner

Examples of a preparation method of the toner according to the present exemplary embodiment include a method of producing a toner using an emulsion aggregation and coalescence process. For example, in producing the toner, a dispersion liquid (for example, a resin particle dispersion liquid) in which materials for forming the toner are dispersed in an aqueous dispersion medium is prepared (emulsification process). Subsequently, the resin particle dispersion liquid and various kinds of other optional dispersion liquids (for example, a colorant dispersion liquid or a release agent dispersion liquid) are mixed, and thus a raw material dispersion liquid is prepared.

Next, in the raw material dispersion liquid, an aggregated particle forming process to form aggregated particles and a coalescing process to coalesce the aggregated particles are carried out, thereby obtaining toner mother particles. When a toner having a so-called core-shell structure that has core particles and a shell layer coating the core particles is prepared, for example, a resin particle dispersion liquid is added to the raw material dispersion liquid after the aggregated particle forming process, and a coating layer forming process is carried out in which the resin particles are adhered onto the surface of the aggregated particles (which form the core particles when toner is formed) to form the coating layer (which forms the shell layer when the toner is formed). Subsequently, a coalescing process is carried out. Here, the resin component in the resin particle dispersion liquid used in the coating layer forming process may be the same as or different from the resin component for forming the core particles. In general, an amorphous resin is used as the resin component.

Hereinafter, each process is described in detail.

Emulsification Process

In order to prepare the raw material dispersion liquid used in the aggregated particle forming process, an emulsification dispersion liquid in which main materials for forming a toner are dispersed in an aqueous medium is prepared in an emulsification process. Hereafter, the resin particle dispersion liquid, the colorant dispersion liquid, and the release agent dispersion liquid are explained.

Resin Particle Dispersion Liquid

The volume average particle diameter of resin particles dispersed in the resin particle dispersion liquid is preferably in the range of 0.01 μm to 1 μm, more preferably in the range of 0.03 μm to 0.8 μm, and still more preferably in the range of 0.03 μm to 0.6 μm.

The volume average particle diameter of particles such as the resin particles contained in the raw material dispersion liquid is measured using a laser diffraction particle size analyzer (trade name: LA-700; manufactured by Horiba, Ltd.).

The dispersion medium used for the resin particle dispersion liquid or other dispersion liquids may be an aqueous medium.

Examples of the aqueous medium include water such as distilled water or ion exchange water and alcohols. These medium may be used singly or in combination of two or more kinds thereof. A surfactant may be added to the aqueous medium.

The surfactant are not specifically limited, and examples thereof include an anionic surfactant such as a sulfate ester salt, a sulfonic ester salt, a phosphoric ester or soap; a cationic surfactant such as an amine salt or a quaternary ammonium salt; a nonionic surfactant such as a polyethylene glycol, an alkylphenol ethyleneoxide adduct or a polyhydric alcohol. Among these surfactants, an anionic surfactant and a cationic surfactant are preferable. The nonionic surfactant may be used together with the anionic surfactant or the cationic surfactant. These surfactants may be used singly or in combination of two or more kinds thereof.

Specific examples of the anionic surfactant include sodium dodecylbenzene sulfonate, sodium dodecyl sulfate, a sodium alkylnaphthalene sulfonate and a sodium dialkylsulfosuccinate. Specific examples of the cationic surfactant include an alkylbenzene dimethyl ammonium chloride, an alkyl trimethyl ammonium chloride and a distearyl ammonium chloride.

Polyester resins have self-dispersibility in water since they contain a functional group that may form an anionic structure by neutralization. Therefore, when a polyester resin is used as the resin particles, an aqueous dispersion is formed by the action of an aqueous medium in which all or part of functional groups that exhibit hydrophilic properties are neutralized with a base.

In the polyester resin, since a functional group that may be converted to a hydrophilic group by neutralization in is an acidic group such as a carboxyl group or a sulfonic acid group, for example, an inorganic base (such as sodium hydroxide, potassium hydroxide, lithium hydroxide, calcium hydroxide, sodium carbonate or ammonia), or an organic base (such as diethylamine, triethylamine or isopropylamine) are used as a neutralizer.

When a resin particle dispersion liquid is prepared by using a polyester resin, a phase inversion emulsifying method may be used. The phase inversion emulsifying method may also be used when a resin particle dispersion liquid is prepared by using a binder resin other than polyester resins. The phase inversion emulsifying method is a method in which a resin to be dispersed is dissolved in a hydrophobic organic solvent in which the resin is soluble, a base is added to an organic continuous phase (O-phase) to neutralize, and then an aqueous medium (W-phase) is added to the neutralized phase. In this manner, the conversion (so-called phase inversion) of the resin from W/O to O/W is occurred to form a discontinuous phase, thereby dispersing the resin in the aqueous medium in particulate form.

Examples of the organic solvent that can be used in the phase inversion emulsification include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol or cyclohexanol; ketones such as methyl ethyl ketone, methyl isobutyl ketone, ethyl butyl ketone, cyclohexanone or isophorone; ethers such as tetrahydrofuran, dimethyl ether, diethyl ether or dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate or dimethyl carbonate; modified compounds of glycol such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate or dipropylene glycol monobutyl ether; and 3-methoxy-3-methylbutanol, 3-methoxybutanol, acetonitrile, dimethyl formamide, dimethyl acetamide, diacetone alcohol and ethyl acetoacetate. These solvents may be used singly or in combination of two or more kinds thereof.

Since the amount of a solvent for obtaining a desired dispersed particle size varies with the physical properties of the resin, in generally, it is difficult to determine the amount of a solvent used for the phase inversion emulsification. In the present exemplary embodiment, since the amount of a tin compound as the catalyst in the resin is relatively large as compared with that in commonly used polyester resins, the amount of the solvent relative to the weight of the resin may be relatively large.

When the binder resin is dispersed in water, all or part of carboxyl groups in the resin may be neutralized with a neutralizer, if necessary. Examples of the neutralizer include inorganic alkalis such as potassium hydroxide or sodium hydroxide; and amines such as ammonia, monomethyl amine, dimethyl amine, triethylamine, monoethylamine, diethylamine, triethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine or N,N-dimethylpropanolamine. Two more kinds of these neutralizers selected may be used in combination. The pH value in the emulsification may be adjusted to neutral by adding the neutralizer, whereby the hydrolysis in the obtained polyester resin dispersion liquid may be prevented.

Furthermore, a dispersant may be added for the purpose of improving the dispersibility of particles or preventing an increase in viscosity of an aqueous medium during the phase inversion emulsification. Examples of the dispersant include water-soluble polymers such as polyvinyl alcohol, methyl cellulose, ethyl cellulose, hydroxyethyl cellulose, carboxymethyl cellulose, sodium polyacrylate or sodium polymethacrylate; anionic surfactants such as sodium dodecylbenzene sulfonate, sodium octadecyl sulfate, sodium oleate, sodium laurate or potassium stearate; cationic surfactants such as laurylamine acetate, stearylamine acetate or lauryl trimethyl ammonium chloride; amphoteric surfactants such as lauryl dimethylamine oxide; nonionic surfactants such as polyoxyethylene alkyl ether, polyoxyethylene alkyl phenyl ether or polyoxyethylene alkylamine; and inorganic compounds such as tricalcium phosphate, aluminum hydroxide, calcium sulfate, calcium carbonate or barium carbonate. These dispersants may be used singly or in combination of two or more kinds thereof. The dispersant may be added in an amount of 0.01 parts by weight to 20 parts by weight, with respect to 100 parts by weight of the binder resin.

The emulsification temperature during the phase inversion emulsification may be lower than the boiling temperature of the organic solvent, and higher than the melting temperature or the glass transition temperature of the binder resin. When the emulsification temperature is lower than the melting temperature or the glass transition temperature of the binder resin, it may be difficult to prepare a resin particle dispersion liquid. When the emulsification is performed at a temperature higher than the boiling temperature of the organic solvent, the emulsification may be performed in a pressurized and sealed container.

The content of the resin particles contained in the resin particle dispersion liquid is preferably from 5% by weight to 50% by weight, and more preferably from 10% by weight to 40% by weight. When the content is within the range, a narrower particle size distribution of the resin particles may be obtained and properties of the toner may be improved.

Colorant Dispersion Liquid

Examples of a dispersing method to prepare the colorant dispersion liquid includes, but not limited thereto, a common dispersing method that uses a rotation shearing homogenizer or a media dispersing apparatus such as a ball mill, a sand mill and DYNO mill. If necessary, an aqueous dispersion of a colorant may be prepared by using a surfactant, or an organic solvent dispersion liquid of a colorant may be prepared by using a dispersant. The surfactant or the dispersant used for forming these dispersion liquids may be the same dispersant as that used for dispersing the binder resin.

The colorant dispersion liquid may be mixed together with a dispersion liquid in which other particles are dispersed at one time when the raw material dispersion liquid is prepared, or may be added and mixed in multiple batches.

The content of the colorant contained in the colorant dispersion liquid is preferably from 5% by weight to 50% by weight, and more preferably from 10% by weight to 40% by weight.

Release Agent Dispersion Liquid

A release agent dispersion liquid is prepared similarly to emulsifying and dispersing a binder resin other than polyester resins. For example, the release agent dispersion liquid is prepared by dispersing the release agent in water with an ionic surfactant or the like, heating the dispersion liquid at temperatures higher than a melting temperature of the release agent, and applying a high shearing force to the dispersion liquid by using a homogenizer or a pressure discharging dispersing apparatus. In this manner, for example, the particles of release agent having the volume average particle diameter of 1 μm or less are dispersed. For example, the same type of dispersion medium as that used for dispersing the binder resin may be used as a dispersion medium in the release agent dispersion liquid.

Examples of the apparatus for mixing, and emulsifying and dispersing the binder resin, a colorant or the like with a dispersion medium include a continuous emulsification-dispersing apparatus such as HOMO MIXER (trade name, manufactured by Primix Corporation), SLASHER (trade name, manufactured by Nippon Coke & Engineering Co., Ltd.), CAVITRON (trade name; manufactured by Eurotec Ltd.), MICROFLUIDIZER (trade name; available from Mizuho Industrial Co., Ltd.), MANTON-GAULIN homogenizer (trade name; manufactured by Manton Gaulin Mfg. Co., Inc.), NANOMIZER (trade name; manufactured by Nanomizer Inc.), STATIC MIXER (trade name; manufactured by Noritake CO., Ltd).

In addition, according to the intended use, the above-described components such as the release agent, the internal additive, the charge control agent or the inorganic powder may be added to the resin dispersion liquid.

When a dispersion liquid of a component other than the binder resin, the colorant and the release agent is prepared, the volume average particle diameter of particles to be dispersed in the dispersion liquid is preferably 1 μm or less, and more preferably from 0.01 μm to 0.5 μm.

Aggregated Particle Forming Process

In the aggregated particle forming process, for example, an aggregating agent may be added to the raw material dispersion liquid obtained by mixing the resin particle dispersion liquid as well as the colorant dispersion liquid, the release agent dispersion liquid and other optional dispersion liquids. Subsequently, the mixture is heated, thereby aggregating these particles to form aggregated particles. In the above-described heating process, for example, the mixture is heated at a temperature below the melting temperature of the crystalline polyester resin, but at a temperature near the melting temperature of the crystalline polyester resin, thereby aggregating these particles to form aggregated particles.

The aggregated particles is formed, for example, by added a aggregating agent to the raw material dispersion liquid while stirring by a rotation shearing homogenizer at room temperature, and adjusting a pH of the raw material dispersion liquid to be acidic. In order to suppress abrupt aggregation due to the heating, the pH may be adjusted during agitation and mixing at room temperature, and optionally, a dispersion stabilizer may be added as necessary.

In the present exemplary embodiment, a "room temperature" means about 25° C.

Examples of the aggregating agent that can be used in the aggregated particle forming process include a surfactant having a polarity opposite to that of the surfactant used as a dispersant added to the raw material dispersion liquid. More specifically, a divalent or higher-valent metal complex and an inorganic metal salt are preferably used. When a metal complex is used as the aggregating agent, the use amount of the surfactant can be reduced, and the chargeability may be improved.

If necessary, an additive which can form a complex or a similar bond with the metal ion in the aggregating agent may be used. A chelating agent may be used as the additive.

Examples of the inorganic metal salt include metal salts such as calcium chloride, calcium nitrate, barium chloride, magnesium chloride, zinc chloride, aluminum chloride or aluminum sulfate; and inorganic metal salt polymers such as poly aluminum chloride, poly aluminum hydroxide or calcium polysulfide. Among these inorganic metal salts, an aluminum salt and the polymer thereof are preferable. In terms of obtaining a narrower particle size distribution, the valency of the inorganic metal salt is preferably higher (for example, divalent is preferred to monovalent, and tri- or higher-valency is preferred to divalent), and an inorganic metal salt polymer, which is a polymer coagulant, is preferable even with the same valency number.

A water-soluble chelating agent may be used as the chelating agent.

Examples of the chelating agent include oxycarboxylic acids such as tartaric acid, citric acid or gluconic acid; imino diacid (IDA), nitrilotriacetic acid (NTA) and ethylenediamine tetraacetic acid (EDTA).

The addition amount of the chelating agent is preferably in the range of from 0.01 parts by weight to 5.0 parts by weight, and more preferably in the range of from 0.1 parts by weight to less than 3.0 parts by weight, with respect to 100 parts by weight of the binder resin.

The chelating agent may be added during or after the aggregated particle forming process or the coating layer forming process. It is not required to control the temperature of the raw material dispersion liquid in adding the chelating agent. The chelating agent may be added at room temperature, or may be added after adjusting the temperature of the chelating agent to the temperature in a reaction vessel in the aggregated particle forming process or the coating layer forming process.

Coating Layer Forming Process

After the aggregated particle forming process, the coating layer forming process may be carried out, if necessary. In the coating layer forming process, resin particles for forming the coating layer are adhered to the surface of the aggregated particles formed in the aggregated particle forming process, thereby forming the coating layer. In this manner, a toner having a so-called core-shell structure can be obtained.

The coating layer may be formed, for example, by additionally adding a resin particle dispersion liquid containing amorphous resin particles to the raw material dispersion liquid containing the aggregated particles (core particles) formed in the aggregated particle forming process.

A coalescence process is carried out after the coating layer forming process. The coating layer may be formed in multiple steps by alternately repeating the coating layer forming process and the coalescence process.

Coalescence Process

In the coalescence process after the aggregated particle forming process, or after the aggregated particle forming process and the coating layer forming process, aggregation reaction is stopped by adjusting the pH value of a suspension containing the formed aggregated particles to the range of from about 6.5 to about 8.5.

After the aggregation is stopped, the aggregated particles are coalesced by heating. The aggregated particles may be coalesced by heating at a temperature higher than the melting temperature of the binder resin.

Washing and Drying Process

After the aggregated particles are coalesced, a washing process, a solid-liquid separation process and a drying process are conducted, thereby obtaining desired toner particles. In the washing process, for example, after the dispersant attached onto the toner particles is removed with a strong acid aqueous solution such as hydrochloric acid, sulfuric acid or nitric acid, and the toner particles are washed with ion exchange water or the like until the pH of the filtrate is neutral. The solid-liquid separation process is not specifically restricted, and suction filtration, pressure filtration, and the like may be used. The drying process is not specifically restricted, and freeze drying, flush jet drying, fluidized drying, vibrating fluidized drying and the like may be used.

In the drying process, generally used methods such as a vibrating fluidized drying method, a spray drying method, a freeze drying method, a flush jet drying method or the like may be used. The water content in the toner particles after drying process is preferably 1.0% by weight or less, and more preferably 0.5% by weight or less.

If necessary, various eternal additives as described above may be added to the toner particles after being dried.

Electrostatic Charge Image Developer

The electrostatic charge image developer (hereinafter, sometimes simply referred to as a "developer") according to the present exemplary embodiment is not specifically limited, as long as the developer contains the toner according to the present exemplary embodiment. The developer of the present exemplary embodiment may be a one-component developer or a two-component developer. When the developer is used as the two-component developer, the toner is used by mixing with a carrier.

Examples of the carrier which can be used in the two-component developer include, but not limited thereto, magnetic metals such as iron oxide, nickel or cobalt; magnetic oxides such as ferrite or magnetite; resin coated carriers having a resin coating layer on the surface of a core material; and magnetic-powder dispersed carriers. Examples of the carrier also include resin-dispersed carriers in which electroconductive materials or the like are dispersed in a matrix resin.

Examples of the coating resin or the matrix resin used for the carriers include, but not limited thereto, polyethylene, polypropylene, polystyrene, polyvinyl acetate, polyvinyl alcohol, polyvinyl butyral, polyvinyl chloride, polyvinyl ether, polyvinyl ketone, a copolymer of vinyl chloride and vinyl acetate, a copolymer of styrene and acrylate, a straight silicone resin containing an organosiloxane bond or the modified products thereof, fluororesin, polyester, polycarbonate, phenol resin and epoxy resin.

Examples of electroconductive material include, but not limited thereto, metals such as gold, silver or copper; and titanium oxide, zinc oxide, barium sulfate, aluminum borate, potassium titanate, tin oxide, and carbon black.

Examples of the core material of the carrier include magnetic metals such as iron, nickel or cobalt; magnetic oxides such as ferrite or magnetite; and glass beads. The core material of carrier may be a magnetic material when the carrier is use for a magnetic brush method.

The volume average particle diameter of the core material of the carrier is preferably in the range of from 10 μm to 500 μm, and more preferably in the range of from 30 μm to 100 μm.

Examples of the method of coating the surface of the carrier core material with a resin include a method in which the carrier core material are coated with a solution obtained by dissolving the above-described coating resin and optionally various additive in a solvent. The solvent is not specifically restricted, and can be appropriately selected in consideration of the coating resin to be used or the coating suitability.

Specifically, examples of the resin coating method include an immersion coating method in which the carrier core material is immersed in a solution for forming a coating layer; a spray coating method in which a solution for forming a coating layer is sprayed onto the surface of the carrier core material; a fluidized-bed coating method in which a solution for forming a coating layer is sprayed onto the surface of the carrier core material in a state where the carrier core material is floated by fluidizing air; and a kneader coater method in which carrier core material and a solution for forming a coating layer are mixed in a kneader coater, and then a solvent is removed.

The mixing ratio (toner:carrier) (weight ratio) of the toner and the carrier in the two component developer is preferably in the range of from 1:100 to 30:100, and more preferably in the range of from 3:100 to 20:100.

Image Forming Device

Hereinafter, an image forming device according to the present exemplary embodiment using the toner for electrostatic charge image development according to the present exemplary embodiment is explained.

The image forming device according to the present exemplary embodiment includes a photoreceptor (image holding member), a charging unit that charges the photoreceptor, an electrostatic charge image forming unit that forms an electrostatic charge image on the surface of the charged photoreceptor, a developing unit that develops the electrostatic charge image formed on the photoreceptor as a toner image using an electrostatic charge image developer according to the present exemplary embodiment, a transfer unit that transfers the toner image onto an image receiving member, and a fixing unit that fixes the toner image on the image receiving member.

In the image forming apparatus, a portion including the developing unit may have a cartridge structure (process cartridge) that is detachably mounted on the main body of the image forming apparatus. As the process cartridge, a process cartridge including at least a developing unit that contains the developer of the present exemplary embodiment for developing an electrostatic charge image is preferably used.

Hereinafter, an example of the image forming apparatus of the present exemplary embodiment is described, however the exemplary embodiment of the invention is not limited thereto. Only the main parts shown in the drawings are described, and the descriptions of other parts are omitted.

FIG. 1 is a diagram illustrating the schematic configuration of a four-drum tandem-type full color image forming apparatus. The image forming apparatus shown in FIG. 1 includes electrophotographic first to fourth image forming units 10Y, 10M, 10C, and 10K (image forming unit) that output images for yellow (Y), magenta (M), cyan (C), and black (K) on the basis of image data subjected to color separation, respectively. The image forming units (hereinafter, simply referred to as "unit") 10Y, 10M, 10C, and 10K are arranged in a horizontal direction at predetermined intervals. The units 10Y, 10M, 10C, and 10K may be a process cartridge that is detachably mounted on the main body of the image forming apparatus.

On the upper side (in terms of the direction of the drawing) of the units 10Y, 10M, 10C, and 10K, an intermediate transfer belt 20 as an intermediate transfer member extends over the units. The intermediate transfer belt 20 is wound around a driving roller 22 and a support roller 24, which are arranged apart from each other in the horizontal direction of the drawing, and the support roller 24 comes into contact with the inner surface of the intermediate transfer belt 20. The intermediate transfer belt 20 travels in a direction from the first unit 10Y toward the fourth unit 10K. The support roller 24 is urged by a spring or the like (not shown) in a direction distant from the driving roller 22, such that predetermined tension is applied to the intermediate transfer belt 20 wound around both rollers. Furthermore, an intermediate transfer member cleaning device 30 is provided to face the driving roller 22 at a side of the image holding member of the intermediate transfer belt 20.

Developing devices (developing units) 4Y, 4M, 4C, 4K corresponding to the units 10Y, 10M, 10C, and 10K are supplied with toners of four colors of yellow, magenta, cyan, and black, which are contained in toner cartridges 8Y, 8M, 8C, and 8K, respectively.

Since each of the first to fourth units 10Y, 10M, 10C, and 10K have the similar configuration, a description will be given for the first unit 10Y that is provided on an upstream side in the travel direction of the intermediate transfer belt to form a yellow image. The same parts as those of the first unit 10Y are represented by the same reference numerals but having different labels magenta (M), cyan (C), and black (K), instead of yellow (Y), and the descriptions of the second to fourth units 10M, 10C, and 10K are omitted.

The first unit 10Y has a photoreceptor 1Y that functions as the image holding member. Around the photoreceptor 1Y are sequentially arranged a charging roller 2Y that charges the surface of the photoreceptor 1Y at a predetermined potential; an exposure device 3 that exposes the charged surface to a laser beam 3Y on the basis of an image signal subjected to color separation, thereby form an electrostatic image; a developing device (developing unit) 4Y that supplies a charged toner to the electrostatic image and develops the electrostatic image; a primary transfer roller 5Y (primary transfer unit) that transfers the developed toner image to the intermediate transfer belt 20; and a photoreceptor cleaning device (cleaning unit) 6Y that removes the toner remaining on the surface of the photoreceptor 1Y after primary transfer.

The primary transfer roller 5Y is disposed inside the intermediate transfer belt 20, and is provided to face the photoreceptor 1Y. In addition, each of the primary transfer rollers 5Y, 5M, 5C, and 5K is connected to a primary bias power source (not shown) and is applied with a primary transfer bias therefrom. The bias power source changes the transfer bias to be applied to the corresponding primary transfer roller under the control of a control unit (not shown).

Hereinafter, the operation of the first unit 10Y to form the yellow image is described. First, before the operation, the charging roller 2Y charges the surface of the photoreceptor 1Y at a potential of from about −600 V to about −800 V.

The photoreceptor 1Y is formed by forming a photosensitive layer on a conductive base substance (volume resistivity at 20° C. is $1\times10^{-6}$ Ωcm or less). The photosensitive layer usually has high resistance (resistance corresponding to general resins), however, when the laser beam 3Y is irradiated, resistivity of a portion irradiated with the laser beam varies. The laser beam 3Y is output to the charged surface of the photoreceptor 1Y through the exposure device 3 according to image data for yellow from the control unit (not shown). The laser beam 3Y is irradiated onto the photosensitive layer on the surface of the photoreceptor 1Y, and accordingly, an electrostatic image having a yellow print pattern is formed on the surface of the photoreceptor 1Y.

The electrostatic image is an image that is formed on the surface of the photoreceptor 1Y by charging. Specifically, the electrostatic image is a so-called negative latent image that is formed as follows: the resistivity of an irradiated portion of the photosensitive layer is decreased by the laser beam 3Y, a charge on the surface of the photoreceptor by flows while a charge in a portion not irradiated with the laser beam 3Y remains.

The electrostatic image formed on the photoreceptor 1Y in this manner is rotated to a predetermined development position as the photoreceptor 1Y travels. Then, at that development position, the electrostatic image on the photoreceptor 1Y becomes a visual image (developed image) by the developing device 4Y.

In the developing device 4Y, an electrostatic charge image developer containing at least a yellow toner and a carrier is contained. The yellow toner is stirred in the developing device 4Y and frictionally charged, and is held on a developer roller (developer holding member) with a charge having the same polarity (negative) as the charge on the photoreceptor 1Y. Then, when the surface of the photoreceptor 1Y passes through the developing device 4Y, the yellow toner is electrostatically adhered to a neutralized latent image portion on the surface of the photoreceptor 1Y, and the latent image is developed by the yellow toner.

A bias potential (development bias), in which an alternate-current component is superimposed on a direct-current component, may be applied to the developer holding member, in view of development efficiency, image graininess, tone reproducibility and the like. More specifically, when the direct-current voltage (Vdc) applied to the developer holding member is from −300 V to −700 V, the width (Vp-p) of a peak value of an alternate-current voltage on the developer holding member may be in the range of from 0.5 kV to 2.0 kV.

The photoreceptor 1Y, on which the yellow toner image is formed, travels at a predetermined speed, and then the toner image developed on the photoreceptor 1Y is transferred to a predetermined primary transfer position.

When the yellow toner image on the photoreceptor 1Y is transferred to the primary transfer position, a predetermined primary transfer bias is applied to the primary transfer roller 5Y. Then, an electrostatic force from the photoreceptor 1Y toward the primary transfer roller 5Y acts on the toner image, and the toner image on the photoreceptor 1Y is transferred to the intermediate transfer belt 20. In this process, the applied transfer bias has a positive (+) polarity opposite to the polarity (−) of the toner. For example, the transfer bias of the first unit 10Y is controlled at approximately +10 μA by the control unit (not shown).

Meanwhile, the toner that remains on the photoreceptor 1Y is removed by the cleaning device 6Y and collected.

The primary transfer bias that is applied to the primary transfer rollers 5M, 5C, and 5K of the second units 10M, 10C, and 10K is controlled in the same manner as in the first unit.

In this manner, the intermediate transfer belt 20, to which the yellow toner image is transferred by the first unit 10Y, sequentially passes through the second to fourth units 10M, 10C, and 10K, such that the toner images for the individual colors are superposed and multiple transferred.

The intermediate transfer belt 20, to which the toner images for four colors are multiple transferred through the first to fourth units reaches a secondary transfer section. The secondary transfer section includes the intermediate transfer belt 20, the support roller 24 that comes into contact with the inner surface of the intermediate transfer belt 20, and a secondary transfer roller (secondary transfer unit) 26 that is arranged at a side of the image holding surface of the intermediate transfer belt 20. A recording paper (image receiving member) P is supplied to a gap between the secondary transfer roller 26 and the intermediate transfer belt 20 through a paper feed mechanism at a predetermined timing, and a predetermined secondary transfer bias is applied to the support roller 24. In this process, the applied transfer bias has a negative (−) polarity identical to the polarity (−) of the toner. An electrostatic force from the intermediate transfer belt 20 toward the recording paper P acts on the toner image, and the toner image on the intermediate transfer belt 20 is transferred to the recording paper P. The secondary transfer bias is determined depending on resistance detected by a resistance detection unit (not shown) of the second transfer section, and the voltage of the secondary transfer bias is controlled.

Subsequently, the recording paper P is forwarded to the fixing device (fixing unit) 28, the toner image is heated, and the color-superposed toner image is fused and fixed on the recording paper P.

Examples of the image receiving member, onto which the toner images are transferred, include plain paper or OHP paper that can be used for an electrophotographic copier or printer.

The recording paper P, on which a color image is fixed, is sent toward a discharge section, and then the color image forming operation is completed.

In the above-described image forming apparatus, the toner image is transferred to the recording paper P through the intermediate transfer belt 20. However, the exemplary embodiment of the invention is not limited thereto. For example, the toner image may be directly transferred from the photoreceptor to the recording paper.

In the image forming device according to the present exemplary embodiment, the toner according to the present exemplary embodiment is contained in the toner cartridge. Further, the developer according to the present exemplary embodiment that contains the toner and the carrier of the present exemplary embodiment is contained in the developing unit.

Process Cartridge and Toner Cartridge

Figure 2:
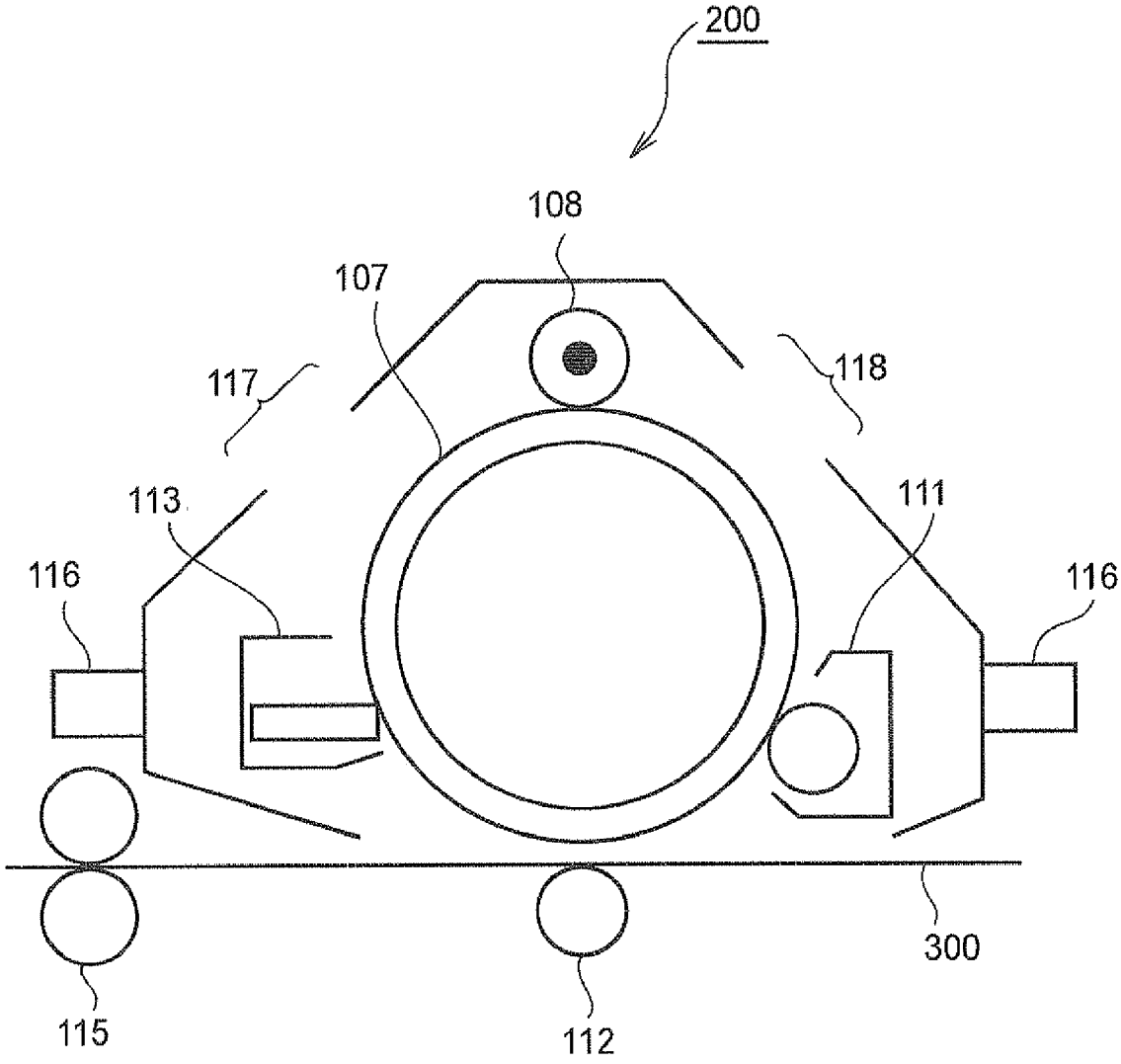
FIG. 2 is a schematic drawing showing an example of a process cartridge according to an exemplary embodiment of the invention.

FIG. 2 is a diagram showing the schematic configuration of a preferable example of a process cartridge that contains the developer of the present exemplary embodiment for developing an electrostatic charge image. A process cartridge 200 assembles a charging device 108, a developing device (developing unit) 111, a photoreceptor cleaning device (cleaning unit) 113, an opening 118 for exposure, and an opening 117 for neutralization exposure by using a mounting rail 116 to integrate, together with the photoreceptor 107. Here, reference numeral 300 indicates a recording paper.

The process cartridge 200 is detachable with respect to the main body of the image forming apparatus including a transfer device 112, a fixing device 115, and other components (not shown). The process cartridge 200 constitutes the image forming apparatus together with the main body of the image forming apparatus.

The process cartridge shown in FIG. 2 includes the photoreceptor 107, the charging device 108, the developing device 111, the cleaning device (cleaning unit) 113, the opening 118 for exposure, and the opening 117 for neutralization exposure. These devices may be select and used in combination. The process cartridge of the exemplary embodiment of the invention includes the developing device 111, and at least one of the photoreceptor 107, the charging device 108, the cleaning device (cleaning unit) 113, the opening 118 for exposure, and the opening 117 for neutralization exposure.

Next, a toner cartridge according to an exemplary embodiment of the invention is described. The toner cartridge of the present exemplary embodiment is preferably a toner cartridge that is detachably mounted on the image forming apparatus, and contains at least a toner to be supplied to a developing unit in the image forming apparatus, in which the toner is the above-described toner of the present exemplary embodiment. The toner cartridge of the present exemplary embodiment may contain at least a toner, or may contain a developer depending on the configuration of the image forming apparatus.

In an image forming apparatus, on which a toner cartridge is detachably mounted, the toner cartridge that contains the toner of the present exemplary embodiment can be used, and the toner for electrostatic charge image development can be easily supplied to the developing unit.

The image forming apparatus shown in FIG. 1 has the configuration on which the toner cartridges 8Y, 8M, 8C, and 8K are detachably mounted, and the developing devices 4Y, 4M, 4C, and 4K are connected to the corresponding toner cartridges through toner supply lines (not shown). When the toner contained in the toner cartridges is used up, the toner cartridges can be replaced.

In the present exemplary embodiment, the photoreceptor is used as the image holding member. However, for example, a dielectric recording member may be used as image holding member.

When the electrophotographic photoreceptor is used as the image holding member, for example, a corotron charging device or a contact charging device may be used as charging unit. A corotron charging device may also be used as the transfer unit.

Image Forming Method

The image forming method according to the exemplary embodiment includes, as described above, at least a latent image forming process for forming an electrostatic latent image on the surface of an image holding member; a developing process for developing the electrostatic latent image formed on the surface of the image holding member using a developer held on the developer holding member to form a toner image; a transfer process for transferring the toner image formed onto the surface of the image holding member to the surface of an image receiving member; and a fixing process for thermally fixing the toner image transferred onto the surface of the image receiving member. In this process, the developer that contains the toner for electrostatic charge image development according to the present exemplary embodiment is used as the developer. The image forming method according to the exemplary embodiment may include a process other than the above processes.

EXAMPLES

Hereinafter, the invention is described in detail with reference to Examples and Comparative Examples, but the invention is not limited to these examples. In addition, "parts" and "%" are based on weight unless otherwise specified.

Preparation of Toner

Preparation Of Crystalline Resin Particle Dispersion Liquid 1

250 parts of 1,10-dodecanedioic acid (polyvalent carboxylic acid), 150 parts of 1,9-nonane diol (polyhydric alcohol), and 0.4 parts of dibutyltin oxide (catalyst) are placed in a three-neck flask which has been dried by heating. Thereafter, the air in the three-neck flask is substituted with an inactive atmosphere by replacement with nitrogen gas using a depressurizing operation. The contents of the flask are refluxed at 180° C. for 5 hours while stirring mechanically. During the reaction, water generated in the reaction system is distilled away. Thereafter, the temperature is gradually raised to 230° C. under reduced pressure and the reaction mixture is stirred for 3 hours. When the contents of the flask become viscous, the molecular weight of the reactant is determined with a GPC (gel permeation chromatography; polystyrene conversion). When the weight average molecular weight is 25,000, the reaction is stopped, thereby obtaining a crystalline polyester resin (crystalline resin 1).

Subsequently, 350 parts of the crystalline polyester resin (crystalline resin 1), 210 parts of methyl ethyl ketone and 61.8 parts of isopropyl alcohol are placed in a separable flask, and sufficiently mixed and dissolved at 40° C. Thereafter, 16.24 parts of a 10% by weight aqueous ammonia solution is added dropwise to the mixture. While the temperature of the mixture is kept at 65° C., ion exchange water is added dropwise to the mixture at a feed rate of 8 g/min using a liquid-feed pump. When the reaction liquid becomes cloudy, the feed rate of the ion exchange water is increased to 12 g/min. The dropwise addition of the ion exchange water is stopped when the total liquid amount reaches 1,400 parts. Thereafter, the solvent is removed under reduced pressure, thereby obtaining a crystalline resin particle dispersion liquid 1. The volume average particle diameter, the solid content concentration and the ester concentration (M) of the obtained crystalline resin particles are shown in Table 1.

Preparation of Crystalline Resin Particle Dispersion Liquids 2 to 4

Each of crystalline resin particle dispersion liquids 2 to 4 is prepared in a manner similar to the crystalline resin particle dispersion liquid 1, except that the polyvalent carboxylic acid and the polyhydric alcohol shown in Table 1 are used. The volume average particle diameter, the solid content concentration and the ester concentration (M) of the obtained crystalline resin particles are shown in Table 1.

TABLE 1

| Crystalline resin particle dispersion liquid | Polyvalent carboxylic acid | Polyhydric alcohol | Type of resin | Volume average particle diameter of resin particles (nm) | Solid content concentration (%) | Ester concentration (M) |
|---|---|---|---|---|---|---|
| 1 | 1,10-dodecanedioic acid | 1,9-nonane diol | Aliphatic | 168 | 31.6 | 0.048 |
| 2 | 1,8-octanedioic acid | 1,4-butane diol | Aliphatic | 164 | 31.6 | 0.071 |
| 3 | 1,10-dodecanedioic acid | 1,10-decane diol | Aliphatic | 165 | 31.6 | 0.045 |
| 4 | Terephthalic acid | 1,10-decane diol | Aromatic | 175 | 31.6 | 0.056 |

Preparation of Amorphous Resin Particle Dispersion Liquid 1

525 parts of bisphenol A to which 2 mol of propylene oxide has been added, 225 parts of bisphenol A to which 2 mol of ethylene oxide has been added, 375 parts of terephthalic acid, 20 parts of fumaric acid, 120 parts of dodecenyl succinic acid (succinic acid 1) which contains a dodecenyl succinic acid having a branched structure (the number of carbon atoms in the branched moiety is 3) at a ratio of 15% by mol, 180 parts of dodecenyl succinic acid (succinic acid 2) which contains a dodecenyl succinic acid having a branched structure (the number of carbon atoms in the branched moiety is 3) at a ratio of 2% by mol or less, and 6 parts of dibutyltin oxide are placed in a three-neck flask which has been dried by heating. Thereafter, the air pressure in the flask is reduced and substituted with an inactive atmosphere by replacement with nitrogen gas using a depressurizing operation. The mixture is reacted at 230° C. for 10 hours at ordinary pressure (101.3 kPa) while stirring mechanically, and is further reacted at a pressure of 8 kPa for 1 hour. The reaction mixture is cooled to 210° C., and then 75 parts of trimellitic anhydride is added thereto and reacted for 1 hour. The mixture is further reacted at a pressure of 8 kPa until the softening temperature reaches 120° C., thereby obtaining an amorphous polyester resin (amorphous resin 1).

Here, the softening temperature is measured using a flow tester CFT-5000 (trade name; manufactured by Shimadzu Corporation) in such a manner that 1 g of a sample is extruded from a nozzle (diameter: 1 mm; length: 1 mm) while heating at a temperature rising speed of 6° C./min and applying a load of 1.96 MPa with a plunger. The temperature at which half of the sample flowed out is defined as the softening temperature.

Subsequently, 350 parts of the amorphous polyester resin obtained by removing insoluble components, 245 parts of methyl ethyl ketone, 70 parts of isopropyl alcohol and 11.2 parts of a 10% aqueous ammonia solution are placed into a separable flask. The contents are mixed and dissolved, and ion exchange water is added dropwise to the mixture using a liquid-feed pump at a feed rate of 8 g/min while stirring and heating at 40° C. When the reaction liquid becomes cloudy, the feed rate of the ion exchange water is increased to 12 g/min to invert the phase of the reaction liquid. The dropwise addition of the ion exchange water is stopped when the total feed amount reaches 1,050 parts. Thereafter, the solvent is removed under reduced pressure, thereby obtaining an amorphous resin particle dispersion liquid 1. The volume average particle diameter, the solid content concentration and the ratio of the number of alkenyl groups having a branched structure of the obtained polyester resin particles are shown in Table 2.

Preparation of Amorphous Resin Particle Dispersion Liquids 2, 5, 6, 9 and 10

Each of amorphous resin particle dispersion liquids 2, 5, 6, 9 and 10 are obtained in a manner similar to the preparation of the amorphous resin particle dispersion liquid 1, except that the addition amounts of succinic acid 1 and the succinic acid 2 are changed to the amounts shown in Table 2. The volume average particle diameter, the solid content concentration and the ratio of the number of alkenyl groups having a branched structure of the obtained polyester resin particles are shown in Table 2.

Preparation Amorphous Resin Particle Dispersion Liquid 3

675 parts of bisphenol A to which 2 mol of propylene oxide has been added, 75 parts of bisphenol A to which 2 mol of ethylene oxide has been added, 300 parts of terephthalic acid, 120 parts of the succinic acid 1, 180 parts of the succinic acid 2 and 6 parts of dibutyltin oxide are placed into a three-neck flask which has been dried by heating. Thereafter, the air pressure in the flask is reduced and substituted with an inactive atmosphere by replacement with nitrogen gas using a depressurizing operation. The mixture is reacted at 230° C. for 10 hours at ordinary pressure (101.3 kPa) while stirring mechanically, and is further reacted at a pressure of 8 kPa for 1 hour. The reaction mixture is cooled to 180° C., 300 parts of fumaric acid and 1.5 parts of hydroquinone are added thereto, and the temperature of the mixture is raised to 210° C. over 4 hours. The mixture is then reacted for 1 hour, and further reacted at a pressure of 8 kPa until the softening temperature reaches 110° C., thereby obtaining an amorphous polyester resin (amorphous resin 3).

Subsequently, 350 parts of the amorphous polyester resin obtained by removing insoluble components, 175 parts of methyl ethyl ketone, 61.8 parts of isopropyl alcohol and 12.3 parts of a 10% aqueous ammonia solution are placed in a separable flask. The contents are mixed and dissolved, and ion exchange water is added dropwise to the mixture using a liquid-feed pump at a feed rate of 8 g/min while stirring and heating at 40° C. After the reaction liquid becomes cloudy, the feed rate of the ion exchange water is increased to 12 g/min to invert the phase of the reaction liquid. The dropwise addition of the ion exchange water is stopped when the total liquid feed amount reaches 1,050 parts. Thereafter, the solvent is removed under reduced pressure, thereby obtaining an amorphous resin particle dispersion liquid 3. The volume average particle diameter, the solid content concentration and the ratio of the number of alkenyl groups having a branched structure of the obtained polyester resin particles are shown in Table 2.

Preparation of Amorphous Resin Particle Dispersion Liquids 4, 7 and 8

Each of amorphous resin particle dispersion liquids 4, 7 and 8 are obtained in a manner similar to the preparation of the amorphous resin particle dispersion liquid 3, except that the addition amounts of the succinic acid 1 and the succinic acid 2 are changed to the amounts shown in Table 2. The volume average particle diameter, the solid content concentration and the ratio of the number of alkenyl groups having a branched structure of the obtained polyester resin particles are shown in Table 2.

Preparation of Amorphous Resin Particle Dispersion Liquid 11

An amorphous resin particle dispersion liquid 11 is obtained in a manner similar to the preparation of the amorphous resin particle dispersion liquid 1, except that dodecenyl succinic acid (succinic acid 3) containing a dodecenyl succinic acid having a branched structure (the number of carbon atoms in the branched moiety is 3) at a ratio of 20% by mol is used in place of the succinic acid 1 and the succinic acid 2 at an amount shown in Table 2. The volume average particle diameter, the solid content concentration and the ratio of the number of alkenyl groups having a branched structure of the obtained polyester resin particles are shown in Table 2.

Preparation of Amorphous Resin Particle Dispersion Liquid 12

An amorphous resin particle dispersion liquid 12 is obtained in a manner similar to the preparation of the amorphous resin particle dispersion liquid 1, except that dodecenyl succinic acid (succinic acid 4) containing a dodecenyl succinic acid having a branched structure (the number of carbon atoms in the branched moiety is 2) at a ratio of 15% by mol is used in place of the succinic acid 1 and the succinic acid 2 at an amount shown in Table 2. The volume average particle diameter, the solid content concentration and the ratio of the number of alkenyl groups having a branched structure of the obtained polyester resin particles are shown in Table 2.

Preparation of Amorphous Resin Particle Dispersion Liquid 13

An amorphous resin particle dispersion liquid 13 is obtained in a manner similar to the preparation of the amorphous resin particle dispersion liquid 1, except that dodecenyl succinic acid (succinic acid 5) containing a dodecenyl succinic acid having a branched structure (the number of carbon atoms in the branched moiety is 4) at a ratio of 15% by mol is used in place of the succinic acid 1 and the succinic acid 2 at an amount shown in Table 2. The volume average particle diameter, the solid content concentration and the ratio of the number of alkenyl groups having a branched structure of the obtained polyester resin particles are shown in Table 2.

Preparation of Amorphous Resin Particle Dispersion Liquid 14

An amorphous resin particle dispersion liquid is obtained 14 in a manner similar to the preparation of the amorphous resin particle dispersion liquid 1, except that dodecenyl succinic acid (succinic acid 6) containing a dodecenyl succinic acid having a branched structure (the number of carbon atoms in the branched moiety is 3) at a ratio of 15% by mol is used in place of the succinic acid 1 and the succinic acid 2 at an amount shown in Table 2. The volume average particle diameter, the solid content concentration and the ratio of the number of alkenyl groups having a branched structure of the obtained polyester resin particles are shown in Table 2.

TABLE 2

| Amorphous resin particle dispersion liquid | Addition amount of alkenyl succinic acid (parts by weight) Succinic acid 1 | Succinic acid 2 | Succinic acid 3 | Succinic acid 4 | Succinic acid 5 | Succinic acid 6 | Volume average particle diameter of resin particles (nm) | Concentration of solid component (%) | Alkenyl groups having branched structure (%) | Number of carbon atoms in branched moiety |
|---|---|---|---|---|---|---|---|---|---|---|
| 1 | 120 | 180 | 0 | 0 | 0 | 0 | 162 | 43.2 | 8 | 3 |
| 2 | 225 | 75 | 0 | 0 | 0 | 0 | 162 | 43.2 | 15 | 3 |
| 3 | 120 | 180 | 0 | 0 | 0 | 0 | 166 | 41.7 | 8 | 3 |
| 4 | 225 | 75 | 0 | 0 | 0 | 0 | 166 | 41.7 | 15 | 3 |
| 5 | 60 | 240 | 0 | 0 | 0 | 0 | 162 | 43.2 | 4 | 3 |
| 6 | 30 | 270 | 0 | 0 | 0 | 0 | 162 | 43.2 | 2 | 3 |
| 7 | 30 | 120 | 0 | 0 | 0 | 0 | 166 | 41.7 | 4 | 3 |
| 8 | 15 | 135 | 0 | 0 | 0 | 0 | 166 | 41.7 | 2 | 3 |
| 9 | 0 | 0 | 0 | 0 | 0 | 0 | 166 | 41.7 | — | — |
| 10 | 90 | 210 | 0 | 0 | 0 | 0 | 162 | 43.2 | 6 | 3 |
| 11 | 0 | 0 | 300 | 0 | 0 | 0 | 162 | 41.7 | 20 | 3 |
| 12 | 0 | 0 | 0 | 300 | 0 | 0 | 162 | 41.7 | 15 | 2 |
| 13 | 0 | 0 | 0 | 0 | 300 | 0 | 162 | 41.7 | 15 | 4 |
| 14 | 0 | 0 | 0 | 0 | 0 | 300 | 162 | 41.7 | 15 | 3 |

Preparation of Release Agent Dispersion Liquid 1

The following components are heated at 110° C., and then dispersed using a homogenizer ULTRA-TURRAX T50 (trade name; manufactured by IKA corporation).

| | |
|---|---|
| Ester wax, WEP5 (trade name; manufactured by Nippon Oil & Fats Co., Ltd.) | 500 parts |
| Anionic surfactant, NEOGEN RK (trade name; manufactured by Dai-ichi Kogyo Seiyaku Co., Ltd). | 50 parts |
| Ion exchange water | 1,700 parts |

The dispersion liquid is further dispersed using MANTON-GAULIN high-pressure homogenizer (trade name; manufactured by Manton Gaulin Mfg. Co., Inc.), whereby a release agent dispersion liquid 1 (concentration of release agent: 31.1%) in which the release agent having an average particle diameter of 0.180 μm has been dispersed is prepared.

Preparation of Colorant Dispersion Liquid

The following components are mixed and dissolved.

| | |
|---|---|
| Cyan pigment:Pigment Blue 15:3 (copper phthalocyanine; manufactured by Dainichiseika Color & Chemicals Mfg. Co., Ltd.) | 1,000 parts |
| Anionic surfactant; NEOGEN RK (trade name; manufactured by Dai-ichi Kogyo Seiyaku Co., Ltd.) | 150 parts |
| Ion exchange water | 9,000 parts |

The mixture is dispersed using a high-pressure-impact type dispersing device ULTIMAIZER HTP-3006 (trade name; manufactured by Sugino Machine Ltd.) for 1 hour, whereby a colorant dispersion liquid 1 in which the colorant (cyan pigment) has been dispersed is prepared.

The average particle diameter of the colorant (cyan pigment) in the colorant dispersion liquid is 0.136 μm; and the concentration of pigment particles is 25.1%.

Preparation of Toner 1

| | |
|---|---|
| Crystalline resin particle dispersion liquid 1 | 57 parts |
| Amorphous resin particle dispersion liquid 1 | 310 parts |
| Colorant dispersion liquid 1 | 62 parts |

-continued

| | |
|---|---|
| Anionic surfactant (20% aqueous solution of DOWFAX 2A1) | 15 parts |
| Release agent dispersion liquid 1 | 77 parts |

First, the crystalline resin particle dispersion liquid 1, the amorphous resin particle dispersion liquid 1, the anionic surfactant and 250 parts of ion exchange water are placed in a polymerization vessel equipped with a pH-meter, an agitation blade and a thermometer, and the polyester resin particle dispersion liquids are mixed with the surfactant while stirring at 130 rpm for 15 minutes. Subsequently, the colorant dispersion liquid 1 and the release agent dispersion liquid 1 are added thereto. Thereafter, an aqueous solution of 0.3 M nitric acid is added to the raw material mixture and the pH value is adjusted to 4.8. Subsequently, 13 parts of an aqueous 10% nitric acid solution of aluminum sulfate (aggregating agent) is added dropwise thereto while applying a shear force to the mixture using ULTRA-TURRAX (at 3,000 rpm). Since the viscosity of the raw material mixture gradually increases during the addition of the aggregating agent, when the viscosity increases, the rate of the dropwise addition of the aggregating agent is suitably controlled so as to prevent the uneven distribution of the aggregating agent. When the dropwise addition of the aggregating agent is completed, the revolution speed is increased to 5,000 rpm and the mixture is stirred for 5 minutes, thereby sufficiently mixing the aggregating agent and the raw material mixture.

Subsequently, the raw material mixture is stirred at 500 rpm while heating at 25° C. for 10 minutes using a mantle heater. Thereafter, the formation of primary particles is confirmed using COULTER MULTISIZER II (trade name; manufactured by Beckman Coulter Inc.; aperture diameter: 50 μm), and then the temperature of the raw material mixture is raised to 43° C. at a rate of 0.1° C./min to grow aggregated particles. The growth of the aggregated particles is confirmed as needed using COULTER MULTISIZER II, and the aggregation temperature or the revolution speed of the stirrer is changed in accordance with the aggregation rate.

Meanwhile, as a coating liquid of the aggregated particles, 118 parts of ion exchange water and 8.2 parts of anionic surfactant DOWFAX 2A1 (trade name: 20% aqueous solution) are added to 171 parts of the amorphous resin particle dispersion liquid 1, and the pH value of the mixture is adjusted to 3.8, thereby obtaining a resin particle dispersion liquid for coating. When the aggregated particles grow to have a size of 5.2 μm in the above-described aggregation process, the obtained resin particle dispersion liquid for coating is added to the aggregated particles, and the mixture is stirred for 20 minutes. Thereafter, 1.5 pph of EDTA is added thereto to stop the growth of the coated aggregated particles, and the pH value of the raw material mixture is adjusted to 7.6 by adding a 1 M aqueous sodium hydroxide solution. Subsequently, in order to initiate the coalescence of the aggregated particles, the temperature of the mixture is raised to 85° C. at a rate of 1° C./min while maintaining the pH value at 7.6. When the temperature reaches 85° C., the pH value is adjusted to 7.6 or less in order to progress the coalescence of the aggregated particles. The coalescence of the aggregated particles is confirmed under an optical microscope. To the mixture, iced water is added, and the temperature thereof is rapidly cooled at a temperature decreasing rate of 10° C./min, thereby stopping the growth of the particles.

Subsequently, for the purpose of washing the obtained particles, the particles are once sieved with a 15 μm mesh sieve. Thereafter, ion exchange water (30° C.) is added in an amount of about 10 times the solid content, and the mixture is stirred for 20 minutes, and then filtered with filter paper. Further, a solid content remained on the filter paper is dispersed in a slurry, washed four times with ion exchange water (30° C.) and dried, thereby obtaining toner particles 1 having a volume average particle diameter of 5.8 μm.

To 100 parts of the obtained toner particles 1, 1.2 parts of titania powder (manufactured by Soken Chemical & Engineering Co., Ltd.) is externally added using an agitation mixer to obtain toner 1.

The volume average particle diameter of the toner 1 is 5.8 μm. The ratio of the number of alkenyl groups having a branched structure in the alkenyl groups of the amorphous polyester resin included in the toner 1 is shown in Table 3.

Preparation of Toners 2 to 31

Each of toners 2 to 31 is obtained in a manner similar to the preparation of the toner 1, except that the types of crystalline resin particle dispersion liquid and amorphous resin particle dispersion liquid are changed as shown in Tables 3 to 5. When two types of amorphous resin particle dispersion liquids are used, respective amorphous resin particle dispersion liquids are used in equal amounts such that total amount of the two types of amorphous resin particle dispersion liquids is the same amount as that of the toner 1. The volume average particle diameter of each of the toners is 5.8 μm. The ratio of the number of alkenyl groups having a branched structure in the alkenyl groups of the amorphous polyester resin included in the respective toners is shown in Tables 3 to 5.

Examples and Comparative Examples

Each of developers of Examples and Comparative Examples is prepared as follows: each of the toners shown in Tables 3 to 5 is weighed such that the concentration of the toner is 5% relative to a ferrite carrier (volume average particle diameter: 35 μm) coated with a polymethyl methacrylate resin (molecular weight: 80,000; manufactured by Soken Chemical & Engineering Co., Ltd.) in an amount of 1%, and the mixture is agitated and mixed for 5 minute using a ball mill.

As an image forming device, a modifying machine of a color copier DOCUCENTRE II-C3300 (trade name; manufactured by Fuji Xerox Co., Ltd.), in which either of direct-current or alternate-current can be applied as the development bias for the developing unit, is used. Specifically, a direct-current bias voltage of −520 V and an alternate-current bias voltage (Vpp) of 1.5 kV are independently applied.

Using the respective developers and the above-described modified machine as an image forming device, an image is formed by supplying the toner at an amount of 15.0 g/m$^2$ and developing by applying a direct-current bias voltage or an alternate-current bias voltage. Thereafter, low-temperature fixability and anti-fogging properties are evaluated.

Evaluation on Low-Temperature Fixability

First, an unfixed image is formed using an image forming device, in which a fixing device is detached from the main body of the image forming device. As the unfixed image, a solid image having a size of 25 mm×25 mm is formed by applying the toner at an amount of 15.0 g/m$^2$, using recording paper JD Paper (trade name; manufactured by Fuji Xerox Co., Ltd.).

Subsequently, a fixing unit of DOCUCENTRE II-C3300 (trade name) is modified such that the fixing temperature is increased by 5° C. from 100° C. to 200° C. The fixability of the unfixed image is evaluated while gradually increasing the fixing temperature.

The evaluation of the fixability is performed as follows: the fixed image without having image defects caused by release failures is folded, a load of 50 g is applied thereto, and the degree of image defects in the folded portion is visually observed. The fixing temperature at which the level of the defects is practically non-problematic, even if slight detachment of an image is observed, is defined as the lowest fixing temperature, and is used as the index of low-temperature fixability. The results are shown in Tables 3 to 5.

Evaluation of Anti-Fogging Properties

Images are continuously printed onto 5,000 sheets of paper using the above-described modified machine DOCUCENTRE II-C3300 under the conditions of a temperature of 35° C. and a relative humidity of 50%, and the development is conducted while applying a direct-current (DC) bias voltage or an alternate-current (AC) bias voltage. Thereafter, another image is formed, and anti-fogging properties thereof are evaluated by visually observing the obtained fixed image and the surface of the photoreceptor.

The anti-fogging properties relating to the fixed images are evaluated in accordance with the following criteria. The results are shown in Tables 3 to 5.

Evaluation Criteria:

A: No fogging is observed at the surface of photoreceptor and fixed images;

B: Fogging is observed at the surface of the photoreceptor, but not observed in the fixed image;

C: Minor fogging is observed in the fixed image, but is practically non-problematic D: Slight fogging is observed in the fixed image, but is practically acceptable E: Slight fogging is observed in the fixed image, and is not practically acceptable F: Noticeable fogging is observed in fixed image, and is not practically acceptable

TABLE 3

| Example | Toner | Crystalline resin particle dispersion liquid | Amorphous crystalline resin particle dispersion liquid | Alkenyl groups having branched structure (%) | Lowest fixing temperature (° C.) | Fog DC | Fog AC |
|---|---|---|---|---|---|---|---|
| Ex. 1 | Toner 1 | 1 | 1 | 8 | 125-130 | A | C |
| Ex. 2 | Toner 2 | 1 | 2 | 15 | 125-130 | A | A |
| Ex. 3 | Toner 3 | 1 | 1 3 | 8 | 130-135 | A | C |
| Ex. 4 | Toner 4 | 1 | 2 3 | 11.5 | 130-135 | A | A |
| Ex. 5 | Toner 5 | 1 | 1 4 | 11.5 | 130-135 | A | C |
| Ex. 6 | Toner 6 | 1 | 2 4 | 15 | 130-135 | A | A |
| Comp. Ex. 1 | Toner 7 | 1 | 5 | 4 | 125-130 | A | E |
| Comp. Ex 2 | Toner 8 | 1 | 6 | 2 | 125-130 | A | F |
| Comp. Ex 3 | Toner 9 | 1 | 5 7 | 4 | 130-135 | A | E |
| Comp. Ex 4 | Toner 10 | 1 | 6 7 | 3 | 130-135 | A | F |
| Comp. Ex 5 | Toner 11 | 1 | 5 8 | 3 | 130-135 | A | E |
| Comp. Ex 6 | Toner 12 | 1 | 6 8 | 2 | 130-135 | A | F |

Ex.: Example;
Comp. Ex.: Comparative Example

TABLE 4

| Example | Toner | Crystalline resin particle dispersion liquid | Amorphous crystalline resin particle dispersion liquid | Alkenyl groups having branched structure (%) | Lowest fixing temperature (° C.) | Fog DC | Fog AC |
|---|---|---|---|---|---|---|---|
| Ex. 7 | Toner 13 | 2 | 1 | 8 | 120-125 | A | D |
| Ex. 8 | Toner 14 | 2 | 2 | 15 | 120-125 | A | B |
| Ex. 9 | Toner 15 | 2 | 1 3 | 8 | 125-130 | A | D |
| Ex. 10 | Toner 16 | 2 | 2 4 | 11.5 | 125-130 | A | B |
| Ex. 11 | Toner 17 | 2 | 1 3 | 11.5 | 125-130 | A | D |
| Ex. 12 | Toner 18 | 2 | 2 4 | 15 | 125-130 | A | B |
| Comp. Ex 7 | Toner 19 | 3 | 5 | 4 | 135-140 | A | D |
| Comp. Ex 8 | Toner 20 | 3 | 6 | 2 | 135-140 | A | E |
| Comp. Ex 9 | Toner 21 | 3 | 5 7 | 4 | 135-140 | A | D |
| Comp. Ex 10 | Toner 22 | 3 | 6 7 | 3 | 135-140 | A | E |
| Comp. Ex 11 | Toner 23 | 3 | 5 8 | 3 | 135-140 | A | D |
| Comp. Ex 12 | Toner 24 | 3 | 6 8 | 2 | 135-140 | A | E |
| Comp. Ex 13 | Toner 25 | 1 | 9 | — | — | — | — |

Ex.: Example;
Comp. Ex.: Comparative Example

TABLE 5

| Example | Toner | Crystalline resin particle dispersion liquid | Non-crystalline resin particle dispersion liquid | Alkenyl groups having branched structure | Lowest fixing temperature (° C.) | Fog DC | Fog AC |
|---|---|---|---|---|---|---|---|
| Ex. 13 | Toner 26 | 1 | 10 | 6 | 125-130 | A | C |
| Ex. 14 | Toner 27 | 1 | 11 | 20 | 125-130 | A | A |
| Ex. 15 | Toner 28 | 1 | 12 | 15 | 125-130 | A | A |
| Ex. 16 | Toner 29 | 1 | 13 | 15 | 125-130 | A | A |

TABLE 5-continued

| Example | Toner | Crystalline resin particle dispersion liquid | Non-crystalline resin particle dispersion liquid | Alkenyl groups having branched structure | Lowest fixing temperature (° C.) | Fog DC | Fog AC |
|---|---|---|---|---|---|---|---|
| Ex. 17 | Toner 30 | 1 | 14 | 15 | 125-130 | A | A |
| Ex. 18 | Toner 31 | 4 | 1 | 8 | 135-140 | A | C |

Ex.: Example;
Comp. Ex.: Comparative Example

As shown in Tables 3 to 5, in Examples, even when an alternate-current field is used in the developing process, fogging is sufficiently suppressed under the conditions of a temperature of 35° C. and a relative humidity of 50% as compared with the case of Comparative Examples.

On the other hand, in Comparative Examples 1 to 12, in which the ratio of the number of alkenyl groups having a branched structure in the amorphous polyester resins is smaller than the range of the present exemplary embodiment, the suppression of fogging is not sufficient as compared with the case of Examples.

Further, in Comparative Example 13, in which alkenyl succinic acid is not contained in the amorphous polyester resin, a toner cannot be obtained.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrostatic charge image development, the toner comprising a binder resin, the binder resin comprising an amorphous polyester resin having alkenyl groups and a crystalline polyester resin, about 5% or more of the alkenyl groups having a branched structure, and the crystalline polyester resin having an ester concentration (M) obtained by the following Equation of from about 0.04 to about 0.08:

$$M=K/A \qquad \text{Equation}$$

wherein, K represents the number of ester bonds in the crystalline polyester resin, and A represents the number of atoms that constitute the polymer chain of the crystalline polyester resin.

2. The toner for electrostatic charge image development according to claim 1, wherein the crystalline polyester resin is an aliphatic polyester resin.

3. The toner for electrostatic charge image development according to claim 1, wherein an acid value (mg of KOH required to neutralize 1 g of resin) of the crystalline polyester resin is from about 1 mg KOH/g to about 30 mg KOH/g.

4. The toner for electrostatic charge image development according to claim 1, wherein a glass transition temperature of the binder resin is from about 45° C. to about 110° C.

5. The toner for electrostatic charge image development according to claim 1, wherein the amorphous polyester resin comprises an alkenyl succinic acid includes an alkenyl group having about 12 to about 18 carbon atoms.

6. The toner for electrostatic charge image development according to claim 5, wherein the alkenyl succinic acid is dodecenyl succinic acid.

7. The toner for electrostatic charge image development according to claim 1, wherein the number of carbon atoms in a branched moiety of the alkenyl groups having a branched structure is from about 2 to about 5.

8. The toner for electrostatic charge image development according to claim 1, wherein the toner further comprises a release agent, and a melting temperature of the release agents is form about 60° C. to about 110° C.

9. The toner for electrostatic charge image development according to claim 8, wherein the content of the release agent is from about 1 part by weight to about 30 parts by weight with respect to 100 parts by weight of the binder resin.

10. The toner for electrostatic charge image development according to claim 1, wherein the melting temperature of the binder resin is from about 45° C. to about 110° C.

11. The toner for electrostatic charge image development according to claim 1, wherein the volume average particle diameter of the toner is from about 1 μm to about 20 μm.

12. An electrostatic charge image developer comprising the toner for electrostatic charge image development according to claim 1.

13. A process cartridge including a developing unit, the developing unit containing the electrostatic charge image developer according to claim 12.

14. An image forming device comprising:

an image holding member;

a charging unit that charges a surface of the image holding member;

an electrostatic charge image forming unit that forms an electrostatic charge image on the surface of the charged image holding member;

a developing unit that develops the electrostatic charge image formed on the surface of the image holding member as a toner image using the electrostatic charge image developer according to claim 12;

a transfer unit that transfers the toner image onto a surface of an image receiving member; and a fixing unit that fixes the toner image on the surface of the image receiving member.

15. The image forming device according to claim 14, wherein the developing unit comprises a developer holding member, and a bias potential in which an alternate-current component is superimposed on a direct-current component is applied to the developer holding member.

16. A toner cartridge containing the toner for electrostatic charge image development according to claim 1.

* * * * *